US011885031B2

(12) United States Patent
Trembly

(10) Patent No.: US 11,885,031 B2
(45) Date of Patent: Jan. 30, 2024

(54) MODULAR ELECTROCATALYTIC PROCESSING FOR SIMULTANEOUS CONVERSION OF CARBON DIOXIDE AND WET SHALE GAS

(71) Applicant: Ohio University, Athens, OH (US)

(72) Inventor: Jason Patrick Trembly, Athens, OH (US)

(73) Assignee: Ohio University, Athens, OH (US)

( * ) Notice: Subject to any disclaimer, the term of this patent is extended or adjusted under 35 U.S.C. 154(b) by 0 days.

(21) Appl. No.: 17/284,589

(22) PCT Filed: Oct. 30, 2019

(86) PCT No.: PCT/US2019/058825
§ 371 (c)(1),
(2) Date: Apr. 12, 2021

(87) PCT Pub. No.: WO2020/092534
PCT Pub. Date: May 7, 2020

(65) Prior Publication Data

US 2021/0262104 A1 Aug. 26, 2021

Related U.S. Application Data

(60) Provisional application No. 62/752,538, filed on Oct. 30, 2018.

(51) Int. Cl.
*C25B 1/23* (2021.01)
*C25B 3/03* (2021.01)
(Continued)

(52) U.S. Cl.
CPC ..... *C25B 1/23* (2021.01); *C25B 9/19* (2021.01); *C25B 9/70* (2021.01); *C25B 15/021* (2021.01)

(58) Field of Classification Search
CPC ..... C25B 1/23; C25B 3/03; C25B 3/26
(Continued)

(56) References Cited

U.S. PATENT DOCUMENTS 4,450,311 A 5/1984 Wright et al.
5,064,733 A * 11/1991 Krist ..... H01M 8/1231 429/496
(Continued)

FOREIGN PATENT DOCUMENTS

WO WO-2015156525 A1 * 10/2015 ..... C01B 31/18
WO 2016178948 A1 11/2016
(Continued)

OTHER PUBLICATIONS

Zhang et al., "Electrochemical Performance Characteristics and Optimum Design Strategies of a Solid Oxide Electrolysis Cell System for Carbon Dioxide Reduction," International Journal of Hydrogen Energy (Aug. 6, 2013), vol. 38, No. 23, pp. 9609-9618. (Year: 2013).*
(Continued)

*Primary Examiner* — Edna Wong
(74) *Attorney, Agent, or Firm* — Wood Herron & Evans LLP

(57) ABSTRACT

An apparatus for converting carbon dioxide and natural gas liquids into other chemicals and/or fuels, comprising at least one electrochemical cell, wherein the electrochemical cell reduces the endothermic load associated with electrochemical $CO_2$ reduction, and a method for converting carbon dioxide and natural gas liquids into carbon monoxide and other chemicals and/or fuels, comprising converting $CO_2$ into CO and converting $C_2H_6$ into $C_2H_4$ at a temperature in the range of 650° C.-750° C.

10 Claims, 24 Drawing Sheets

(51) Int. Cl.

| | |
|---|---|
| ***C25B 3/26*** | (2021.01) |
| ***C25B 15/021*** | (2021.01) |
| ***C25B 9/70*** | (2021.01) |
| ***C25B 9/19*** | (2021.01) |

(58) Field of Classification Search
USPC ..... 205/462, 555, 615
See application file for complete search history.

(56) References Cited

U.S. PATENT DOCUMENTS

| | | | | |
|---|---|---|---|---|
| 5,300,271 | A | 4/1994 | Golden et al. | |
| 6,051,125 | A | 4/2000 | Pham et al. | |
| 8,591,718 | B2 | 11/2013 | Lane et al. | |
| 9,035,118 | B2 | 5/2015 | Serban et al. | |
| 9,285,116 | B2 | 3/2016 | Schmid et al. | |
| 2012/0329657 | A1 * | 12/2012 | Eastman | F02M 27/04 505/150 |
| 2016/0040311 | A1 | 2/2016 | Jakobsson et al. | |
| 2016/0222528 | A1 * | 8/2016 | Bedell | C25B 3/25 |
| 2018/0022664 | A1 * | 1/2018 | Yao | C01B 39/38 585/510 |
| 2020/0122127 | A1 * | 4/2020 | Bae | B01J 35/1014 |

FOREIGN PATENT DOCUMENTS

| | | | | |
|---|---|---|---|---|
| WO | 2017085604 | A2 | 5/2017 | |
| WO | WO-2017144403 | A1 * | 8/2017 | C01B 3/38 |
| WO | WO-2019173858 | A1 * | 9/2019 | H01M 8/04302 |

OTHER PUBLICATIONS

Vora et al., "Economic Route for Natural Gas Conversion to Ethylene and Propylene," Studies in Surface Science and Catalysis (Jan. 1, 1997), vol. 107, pp. 87-98. (Year: 1997).*

Thomas et al., "The Absorption of Carbon Monoxide in an Aqueous Solution of Cuprous Ammonium Lactate in a Packed Tower," Journal of Applied Chemistry (Jan. 1965), vol. 15, No. 1, pp. 17-28. (Year: 1965).*

International Search Report and Written Opinion in International Patent Application No. PCT/US2019/058825, dated Jan. 21, 2020, 10 pgs.

"Ethane production expected to increase as petrochemical consumption and exports expand—Today in Energy—U.S. Energy Information Administration (EIA)." [Online]. Available: https://www.eia.gov/todayinenergy/detail.php?id=25632.

Allen, S., "Conversion of Waste CO2 and Shale Gas to High Value Chemicals." Jul. 2016.

Andrei, R. D. et al., "Heterogeneous oligomerization of ethylene over highly active and stable Ni-AISBA-15 mesoporous catalysts," J. Catal., vol. 323, pp. 76-84, Mar. 2015.

Babu, B. H. et al., "An integrated process for production of jet-fuel range olefins from ethylene using Ni-AISBA-15 and Amberlyst-35 catalysts," Appl. Catal. Gen., vol. 530, pp. 48-55, Jan. 2017.

Bidrawn, F. et al., "Efficient Reduction of CO2 in a Solid Oxide Electrolyzer," Electrochem. Solid-State Lett., vol. 11, No. 9, pp. B167-B170, Sep. 2008.

Cetinkaya, E. et al., "Life cycle assessment of various hydrogen production methods," 2010 AIChE Annu. Meet. Top. Conf. Hydrog. Prod. Storage Spec. Issue, vol. 37, No. 3, pp. 2071-2080, Feb. 2012.

De la Pena O'Shea, V. A. et al., "Development of Hexagonal Closed-Packed Cobalt Nanoparticles Stable at High Temperature," Chem. Mater., vol. 21, No. 23, pp. 5637-5643, Dec. 2009.

Dong, X. et al., "Techno-economic analysis of hydraulic fracking flowback and produced water treatment in supercritical water reactor," Energy, vol. 133, pp. 777-783, Aug. 2017.

Fergus, J. W., "Oxide anode materials for solid oxide fuel cells," Solid State Ion., vol. 177, No. 17, pp. 1529-1541, Jul. 2006.

Garlapalli, R. et al., "Integration of Heat Recovery Unit in Coal Fired Power Plants to Reduce Energy Cost of Carbon Dioxide Capture," Appl. Energy 229 (2018) 900-909.

Gomez, F. J. P., "Mechanism of Sulfur Poisoning By H2S and SO2 of Nickel and Cobalt Based Catalysts for Dry Reforming of Methane." Mar. 2016.

Gu, X.-K. et al., "First-Principles Study of High Temperature CO2 Electrolysis on Transition Metal Electrocatalysts," Ind. Eng. Chem. Res., vol. 56, No. 21, pp. 6155-6163, May 2017.

H. T. A/S (HQ), "Produce your own CO B'eCOs™ it's better | eCOs | CO2 to CO | CO supplier | CO supply | CO onsite | CO plant." [Online]. Available: https://info.topsoe.com/ecos.

Hidaka, Y. et al., "Shock-tube and modeling study of ethane pyrolysis and oxidation," Combust. Flame, vol. 120, No. 3, pp. 245-264, Feb. 2000.

Hidaka, Y. et al., "Shock-tube and modeling study of methane pyrolysis and oxidation," Combust. Flame, vol. 118, No. 3, pp. 340-358, Aug. 1999.

Hwang, A. et al., "Low Temperature Oligomerization of Ethylene over Ni/Al-KIT-6 Catalysts," Catal. Lett., vol. 147, No. 6, pp. 1303-1314, Jun. 2017.

Kim-Lohsoontorn, P. et al., "Electrochemical performance of solid oxide electrolysis cell electrodes under high-temperature coelectrolysis of steam and carbon dioxide," Proc. 2010 Eur. Solid Oxide Fuel Cell Forum, vol. 196, No. 17, pp. 7161-7168, Sep. 2011.

Lin, S. et al., "Tuning the pore structure of plug-containing Al-SBA-15 by post-treatment and its selectivity for C16 olefin in ethylene oligomerization," Microporous Mesoporous Mater., vol. 184, pp. 151-161, Jan. 2014.

Maeda, A. et al., "Measurement and Numerical Simulation of Temperature Distributions of a Micro-Tubular SOEC during H2O/CO2 Co-Electrolysis," ECS Trans., vol. 78, No. 1, pp. 3113-3121, May 2017.

Moon, S. et al., "Oligomerization of light olefins over ZSM-5 and beta zeolite catalysts by modifying textural properties," Appl. Catal. Gen., vol. 553, pp. 15-23, 2018.

Moussa, S. et al., "Heterogeneous oligomerization of ethylene to liquids on bifunctional Ni-based catalysts: The influence of support properties on nickel speciation and catalytic performance," Sel. Pap. 6th Czech-Ital.-Span. Conf. Mol. Sieves Catal. Amantea Italy Jun. 14, 17, 2015, vol. 277, pp. 78-88, Nov. 2016.

Salkuyeh, Y. K., et al., "Techno-economic analysis and life cycle assessment of hydrogen production from natural gas using current and emerging technologies," Int. J. Hydrog. Energy, vol. 42, No. 30, pp. 18894-18909, Jul. 2017.

Spasojevic, M. et al., "The Phase Structure and Morphology of Electrodeposited Nickel-Cobalt Alloy Powders," Sci. Sinter., vol. 43, No. 3, pp. 313-326, Dec. 2011.

Suleman, F. et al., "Comparative impact assessment study of various hydrogen production methods in terms of emissions," Spec. Issue Prog. Hydrog. Prod. Appl. ICH2P-2015 May 3-6, 2015 Oshawa Ont. Can., vol. 41, No. 19, pp. 8364-8375, May 2016.

Tanim, T. et al., "Modeling a 5 kWe planar solid oxide fuel cell based system operating on JP-8 fuel and a comparison with tubular cell based system for auxiliary and mobile power applications," J. Power Sources, vol. 245, pp. 986-997, Jan. 2014.

Tanim, T. et al., "Modeling of a 5 kWe tubular solid oxide fuel cell based system operating on desulfurized JP-8 fuel for auxiliary and mobile power applications," J. Power Sources, vol. 221, pp. 387-396, Jan. 2013.

Xie, Y. et al., "Electrolysis of Carbon Dioxide in a Solid Oxide Electrolyzer with Silver-Gadolinium-Doped Ceria Cathode," J. Electrochem. Soc., vol. 162, No. 4, pp. F397-F402, Jan. 2015.

Yang, M. et al., "Manufacturing Ethylene from Wet Shale Gas and Biomass: Comparative Technoeconomic Analysis and Environmental Life Cycle Assessment," Ind. Eng. Chem. Res., vol. 57, No. 17, pp. 5980-5998, May 2018.

Younessi-Sinaki, M. et al., "Kinetic model of homogeneous thermal decomposition of methane and ethane," Int. J. Hydrog. Energy, vol. 34, No. 9, pp. 3710-3716, May 2009.

Zhan, Z. et al., "Syngas Production By Coelectrolysis of CO2/H2O: The Basis for a Renewable Energy Cycle," Energy Fuels, vol. 23, No. 6, pp. 3089-3096, Jun. 2009.

(56) References Cited

OTHER PUBLICATIONS

Zhang, L. et al., "Electrochemical reduction of CO2 in solid oxide electrolysis cells," J. Energy Chem., vol. 26, No. 4, pp. 593-601, Jul. 2017.

* cited by examiner

CATHODE 1: $CO_2+2e^- \rightarrow CO + O^{2-}$

CATHODE 2: $O_2+4e^- \rightarrow 2O^{2-}$

ANODE: $C_2H_6+O^{2-} \rightarrow C_2H_4+2e^-$

CATHODE 2: $O_2+4e^- \rightarrow 2O^{2-}$
ANODE: $C_2H_6+O^{2-} \rightarrow C_2H_4+2e^-$

MODULAR ELECTROCATALYTIC PROCESSING FOR SIMULTANEOUS CONVERSION OF CARBON DIOXIDE AND WET SHALE GAS

CROSS-REFERENCE TO RELATED APPLICATION

This application claims the benefit of the filing date of U.S. Patent Application Ser. No. 62/752,538, filed on Oct. 30, 2018, the disclosure of which is incorporated by reference herein in its entirety.

STATEMENT REGARDING FEDERALLY SPONSORED RESEARCH OR DEVELOPMENT

This invention was made with government support under DE-FOA-0001940 and DE-FOA-0001849 awarded by U.S. Department of Energy. The U.S. Government has certain rights in the invention.

FIELD OF THE INVENTION

The present invention generally relates to conversion of $CO_2$ and wet shale gas, and to an electrochemical platform for such conversion.

BACKGROUND OF THE INVENTION

This section is intended to introduce the reader to various aspects of art that may be related to various aspects of the present invention, which are described and/or claimed below. This discussion is believed to be helpful in providing the reader with background information to facilitate a better understanding of various aspects of the present invention. Accordingly, it should be understood that these statements are to be read in this light, and not as admissions of prior art.

Carbon monoxide (CO) is an important industrial gas used in manufacturing bulk chemicals. The vast majority of CO (>90%), is converted into chemicals such as methanol when in the form of syngas with $H_2$. However, industrial gas suppliers including Praxair, Linde, Air Liquide and Air Products, competitively produce bulk CO for the chemical industry. Although public information regarding the bulk U.S. CO market is limited, the present inventor estimates major industrial gas suppliers generate 300-400 MMscf/day CO with an annual market value of $1.24-1.66 billion. The bulk CO market is growing as both Praxair and Air Products are adding 13.5 and 6.5 MMscf/day CO production facilities, respectively. Bulk CO is used in the production of several important chemical precursors such as phosgene and commodity materials via carbonylation including aldehydes, ketones, carboxylic acids, anhydrides, esters, amides, imides, carbonates, ureas, and isocyanates. Further, high purity CO (>99.99%) is used in electronics manufacturing. Further growth of the bulk CO market is expected as a significant amount of chemical manufacturing returns to the U.S. due to low hydrocarbon pricing from unconventional gas reservoirs. As CO production costs are highly sensitive to capital costs, most commercial CO production facilities have production capacities greater than 5 MMscf/day. CO manufacturing in the U.S. consumes upwards of 200 billion standard cubic feet of natural gas annually.

Industrial bulk CO is produced by separating CO from syngas (containing $H_2$) typically generated via steam methane reforming (SMR) using natural gas as the feedstock. Various separation technologies are used including cryogenic separation (i.e. cold box), pressure swing adsorption (PSA), membrane separation, and ammonium salt solution absorption. Design of the system is highly dependent upon feed gas composition and typically natural gas containing <1 vol % $N_2$ is used. Some limited use of membrane separation is used in facilities producing <0.5 MMscf/day CO. However, as CO production cost is highly dependent upon process capital (80-85%), larger production facilities >5 MMscf/day are preferred ["HyCO Praxair Interview," 14 Jun. 2018]. The cold box process, shown in FIG. 2, causes partial condensation of CO from $H_2$ at cryogenic conditions.

This process typically generates bulk CO (98-99 vol %) and $H_2$ (97-98 vol %) products. Before undergoing cryogenic separation, the CO-containing feed gas is first treated to remove carbon dioxide and water. The feed gas is compressed to pressures (24-35 bar) which allow temperatures to be reached to cause partial condensation of CO (−130 to 106° C.). The cryogenic partial condensation cycle consists of flashing and heat exchange which yields a CO product from the $CO/CH_4$ splitter [*Ullmann's Energy: Resources, Processes, Products*, vol. 2. 2015; and H. Gunardson, *Industrial Gases in Petrochemical Facilities*. Marcel Dekker, Inc., 1998]. The compression/expansion and high degree of heat integration required for this process make it capital intensive with CO pricing sensitive or process scale. If greater CO purity is desired, a liquid methane wash unit operating at −180° C. is used [*Ullmann's Energy: Resources, Processes, Products*, vol. 2. 2015; and H. Gunardson, *Industrial Gases in Petrochemical Facilities*. Marcel Dekker, Inc., 1998].

Additionally, the U.S. has seen tremendous growth of natural gas liquids (NGLs) supply over recent years, due to the development of unconventional resources. The majority of the new NGL capacity comes from natural gas producing plays (Utica and Marcellus shale) and associated gas from tight oil production (Eagle Ford and Bakken shale). The processing of natural gas into pipeline-quality dry natural gas is complex/costly and involves several processes to remove oil, water, acid gases, and NGLs. NGL recovery is a capital and energy intensive process utilizing cryogenic distillation requiring stages of compression/expansion with high degrees of heat integration. $C_2H_6$, which is the most abundant NGL component, is the major feedstock to the steam cracking and petrochemical industry. FIG. 1 shows current and future U.S. $C_2H_6$ production and conversion capacities, demonstrating a significant oversupply of $C_2H_6$. Midstream gas plant production of $C_2H_6$ has increased annually for 12 years.

To address the gap between $C_2H_6$ supply and capacity, natural gas processors reject $C_2H_6$ at the separation facility sending it to the natural gas pipeline for sale. Although $C_2H_6$ rejection is useful in eliminating the costs associated with cryogenic separation, it results in overall revenue loss as ethane typically sells at a small premium in comparison to natural gas. In addition, $C_2H_6$ rejection is a limited management technique as pipeline-quality natural gas must be delivered at a sufficient hydrocarbon dew point temperature to prevent condensate formation at pipeline pressure. In recent years, interstate pipeline operators have begun to more closely monitor and enforce dew point temperature specifications to prevent operational issues, further restricting this $C_2H_6$ management technique. Re-injection of $C_2H_6$ into oil wells is another potential market; however, the majority of new $C_2H_6$ production either does not possess sufficient mid-stream gas separation capacity (Bakken shale) or well re-injection capacity (Utica and Marcellus shales) to make this a viable option. Finally, significant exportation of $C_2H_6$ is a limited management route as the majority of new $C_2H_6$ capacity is not located near U.S. coasts. Although new $C_2H_6$ conversion capacity is coming online in the U.S., this new capacity will be unable to keep up with $C_2H_6$ production providing a window of need for new technologies such as the proposed electrochemical processing method.

$C_2H_6$ and other NGLs are separated from natural gas (i.e. $CH_4$) via a turbo-expansion process (FIG. 3A) combined with external refrigerant to recover approximately 80% of $C_2H_6$ contained in natural gas. This processing is particularly important for WNG to prepare it for transport in interstate pipelines. First, the raw natural gas is compressed and treated to remove acid gases ($H_2S$, $CO_2$, etc.), typically via a monoethanolamine (MEA)-based absorption unit to produce the sweet gas, which is then dehydrated using triethylene glycol (TEG). Following dehydration, the gas enters a cryogenic separation unit where NGLs are recovered. Cryogenic separation is accomplished via heat integration and expansion of the gas causing its temperature to reach −90° C., before entering the demethanizer. In the demethanizer, a bottom liquid NGL stream ($C_2$+ mixture) and top methane-rich stream are produced. If further separation of the liquid NGL stream is desired, a fractionation train (FIG. 3B) is used in generating separate ethane, propane, and 03 streams.

Ethane, which is the most abundant NGL component, is the major feedstock to the steam cracking and petrochemical industry. FIG. 1 shows current and future U.S. ethane production and conversion capacities, demonstrating a significant oversupply of ethane. To address the gap between ethane supply and capacity, natural gas processors reject ethane at the separation facility sending it to the natural gas pipeline for sale. Although ethane rejection is useful in eliminating the costs associated with cryogenic separation, it results in overall revenue loss as ethane typically sells at a premium in comparison to natural gas. In addition, ethane rejection is a limited management technique as pipeline-quality natural gas must be delivered at a hydrocarbon dew point temperature that prevents condensate formation at pipeline pressure. Over recent years interstate pipeline operators have begun to closely monitor and enforce dew point temperature specifications to prevent operational issues, further restricting this ethane management technique. Re-injection of ethane into oil wells is another potential strategy; however, the majority of new ethane production either does not possess sufficient petrochemical processing capacity (Bakken and Utica/Marcellus shales) or well re-injection capacity (Utica and Marcellus shales) to make this a viable option. Finally, significant exportation of NGLs is limited as ethane pipeline capacity in these areas is significantly lower than production.

The issue of ethane rejection/reinjection is intensified in areas such as the Utica and Bakken shale plays, as these reservoirs produce natural gas with significant C2+ content (Table 1) and are not geographically located within areas possessing significant petrochemical processing capacity. The Utica shale, especially in Eastern The present inventor, has seen significant development over the past 7 years and generates over 2 TCF of gas annually. The Appalachian shale basin (Utica and Marcellus shales) possesses sufficient gas processing capacity; however, limited cracking capacity is located in the region leading to most of the separated ethane feedstock being transported to the Gulf Coast for processing. The conversion of ethane to ethylene and subsequent derivative chemicals represents a vast value-chain, causing this economically impoverished region to lose critical jobs and associated creation of wealth. Similarly, the limited cracking capacity in the Bakken inhibits this region from realizing the full economic potential of its vast unconventional hydrocarbon resources.

To address this issue, cost-effective modular gas separation technologies which may be implemented at the well head are desired. Current cryogenic gas separation technologies will not be cost-effective at individual well head gas throughputs because of technical limitations in scaling down the process. Furthermore, modular methodologies which directly convert NGLs into more value-added intermediates or materials (such as chemicals or fuels), without need for prior separation, would be the most advantageous as such technologies would reduce flaring of associated gas from oil wells and alleviate mid-stream gas separation bottlenecks.

TABLE 1

Utica Shale and Bakken Associated Gas Composition Ranges

| Component | Utica Shale | Bakken |
|---|---|---|
| $CH_4$ | 56-77 mol % | 48-74 mol % |
| $C_2H_6$ | 17-40 mol % | 13-20 mol % |
| $C_{3-6+}$ | 4-14 mol % | 13-35 mol % |

SUMMARY OF THE INVENTION

Certain exemplary aspects of the invention are set forth below. It should be understood that these aspects are presented merely to provide the reader with a brief summary of certain forms the invention might take and that these aspects are not intended to limit the scope of the invention. Indeed, the invention may encompass a variety of aspects that may not be explicitly set forth below.

One aspect of the present invention is the development of cost-effective technologies which convert $CO_2$ into valuable products which offer a more sustainable carbon lifecycle over conventional methods. A first step towards developing $CO_2$ reuse technologies is to identify methodologies that are compatible with the current energy infrastructure and offer synergisms between two or more energy sectors. In part, this disclosure describes an intermediate temperature solid oxide electrolyzer cell (SOEC) technology that simultaneously converts $CO_2$ into CO and separates $C_2H_6$ from WNG using electrical power, which offers lower $CO_2$ lifecycle emissions when compared to the current conventional cryogenic separation pathways. It is anticipated that the invention described herein may: (1) Identify new Co—Ni electrocatalyst which offer cost effective/selective conversion of $CO_2$ to CO at intermediate temperatures; (2) Identify new e-ODH electrocatalyst which offer cost effective/selective conversion of $C_2H_6$ to $C_2H_4$ at intermediate temperatures; (3) Demonstrate process feasibility; and (4) Identify the most competitive process integration schemes for conversion of $CO_2$ from coal-fired power plants.

Impacts from successful development of the technology include increased U.S. environmental responsibility within the power generation, oil/gas, and chemical manufacturing sectors. Reduction in $CO_2$ emissions from the production of CO and separation of $C_2H_6$ by the proposed process are approximately 13.5 and 7.1 MMton/yr, respectively.

The proposed technology has utility for at least three industry sectors, including fossil-based power generation, oil/gas industry, and chemicals manufacturing sector. Specific utilities the process described herein offers include: (1) Provide fossil-based power plants a means of economically converting a portion of their GHG emissions into valuable products to offset carbon capture costs; (2) A modular means to selectively remove $C_2H_6$ from WNG, addressing $C_2H_6$ oversupply and separation bottleneck facing the U.S. natural gas industry; and (3) A synergistic source of bulk CO to support the growing chemicals manufacturing sector.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

One aspect of the present invention provides a process that converts $CO_2$ and NGLs (mainly $C_2H_6$) in wet natural gas (WNG) into valuable CO and chemicals/fuels respectively, using electrical energy. The conversion of $CO_2$ and NGLs may occur simultaneously. This includes an intermediate temperature solid oxide electrolyzer cell (SOEC) process configuration that offers the technical feasibility of producing CO and removing $C_2H_6$ from WNG at costs equivalent to current commercial processes, with significant reduction in lifecycle $CO_2$ emissions over conventional processes. Additional aspects of the present invention allow for integration of the proposed process into a coal-fired power plant facility for direct utilization of $CO_2$ containing flue gas to match current commercial CO production and NGL separation costs.

Figure 4A:
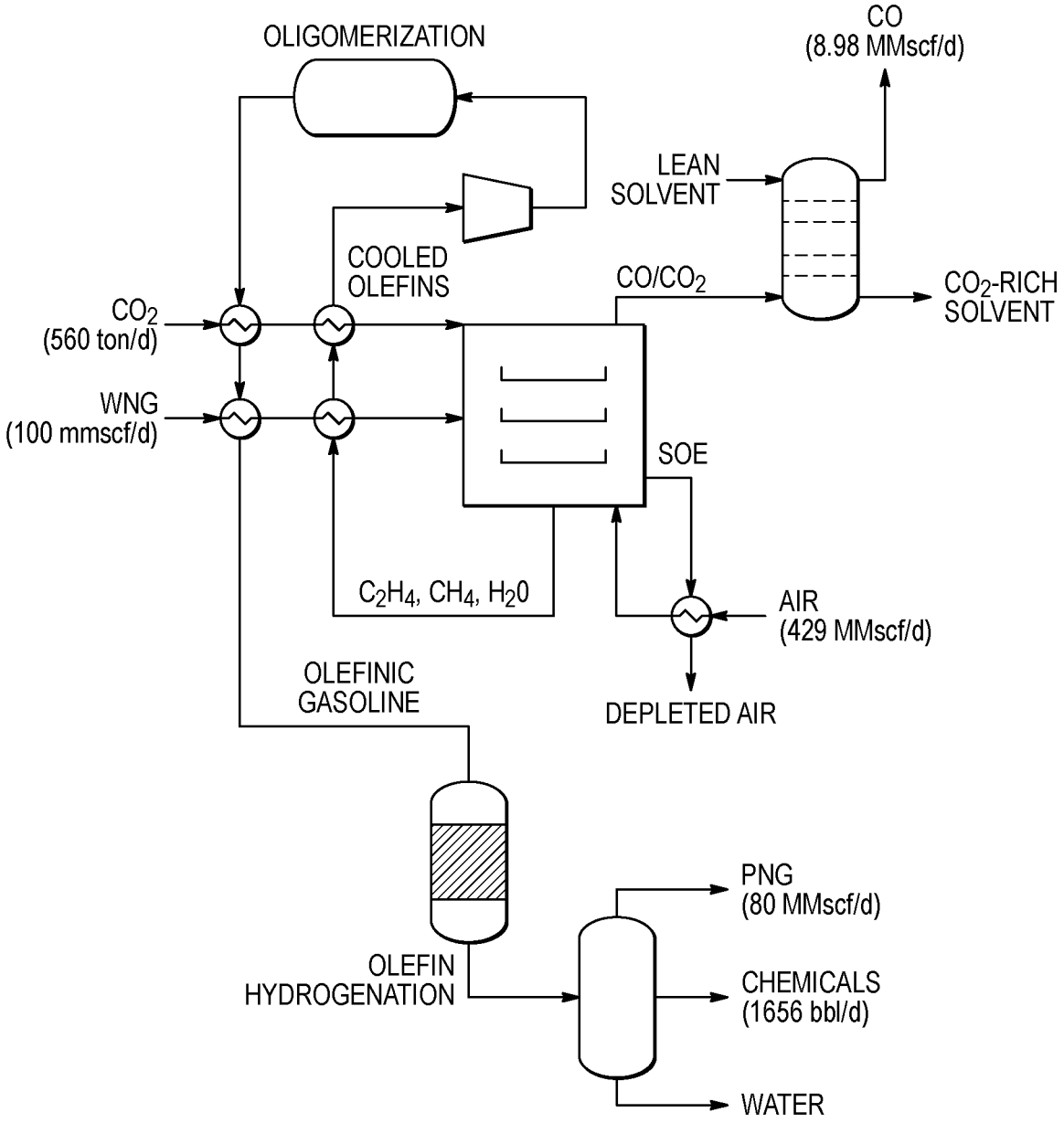
FIG. 4A is a schematic of a $CO_2$ reuse process in accordance with the principles of the present invention.

In general, the present inventor's proposed $CO_2$ reuse process involves the reduction of $CO_2$ and conversion of NGLs ($C_2H_6$) contained in natural gas using electrical power to generate valuable CO and chemicals/fuels. A simplified process flow diagram for the concept is shown in FIG. 4A. The process is based on an intermediate-temperature (650-750° C.) solid oxide electrolyzer stack design. This particular embodiment was selected to take advantage of commercial solid oxide fuel cell (SOFC) platform technology (although others may be considered, used, etc.). This process concept addresses challenges associated with $CO_2$ reuse processes through a host of innovations including: (1) Producing multiple value-added products (CO and chemicals/fuels) increasing process economic potential; (2) Utilizing SOFC technology operating at intermediate temperatures (650-750° C.) relaxing C and O bonding to reduce overall process energetics; (3) Ability to integrate into multiple existing/new fossil power cycles (PC, IGCC, or NGCC, Alam power cycle), refinery, or oil/gas field operations via SOFC platform modularity; and (4) Addressing $C_2H_6$ oversupply and separation bottleneck facing the U.S. natural gas industry.

Figure 4B:
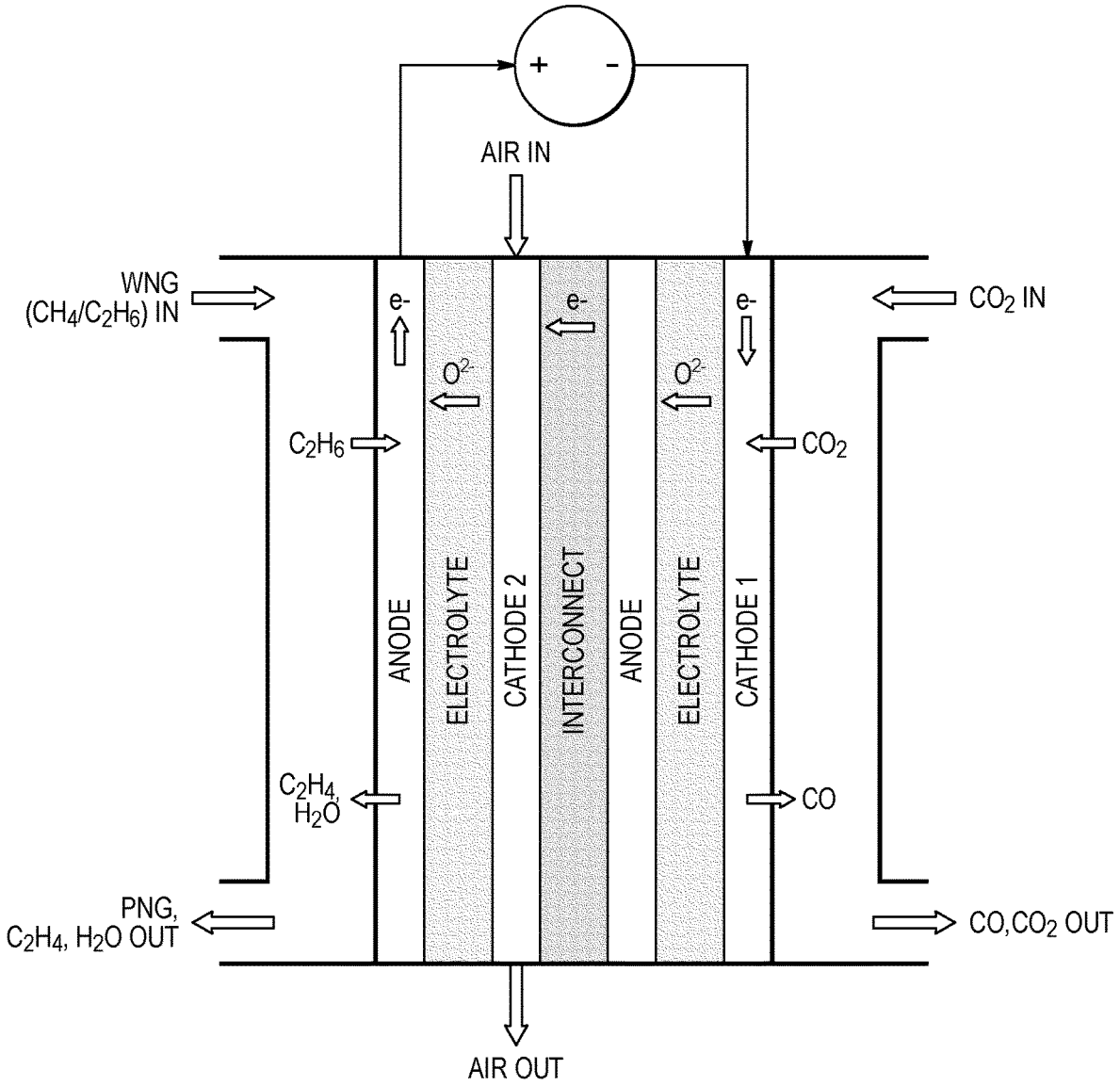
FIG. 4B is a schematic of a SOEC for simultaneous $CO_2$/WNG conversion in accordance with the principles of the present invention.
Figure 5:
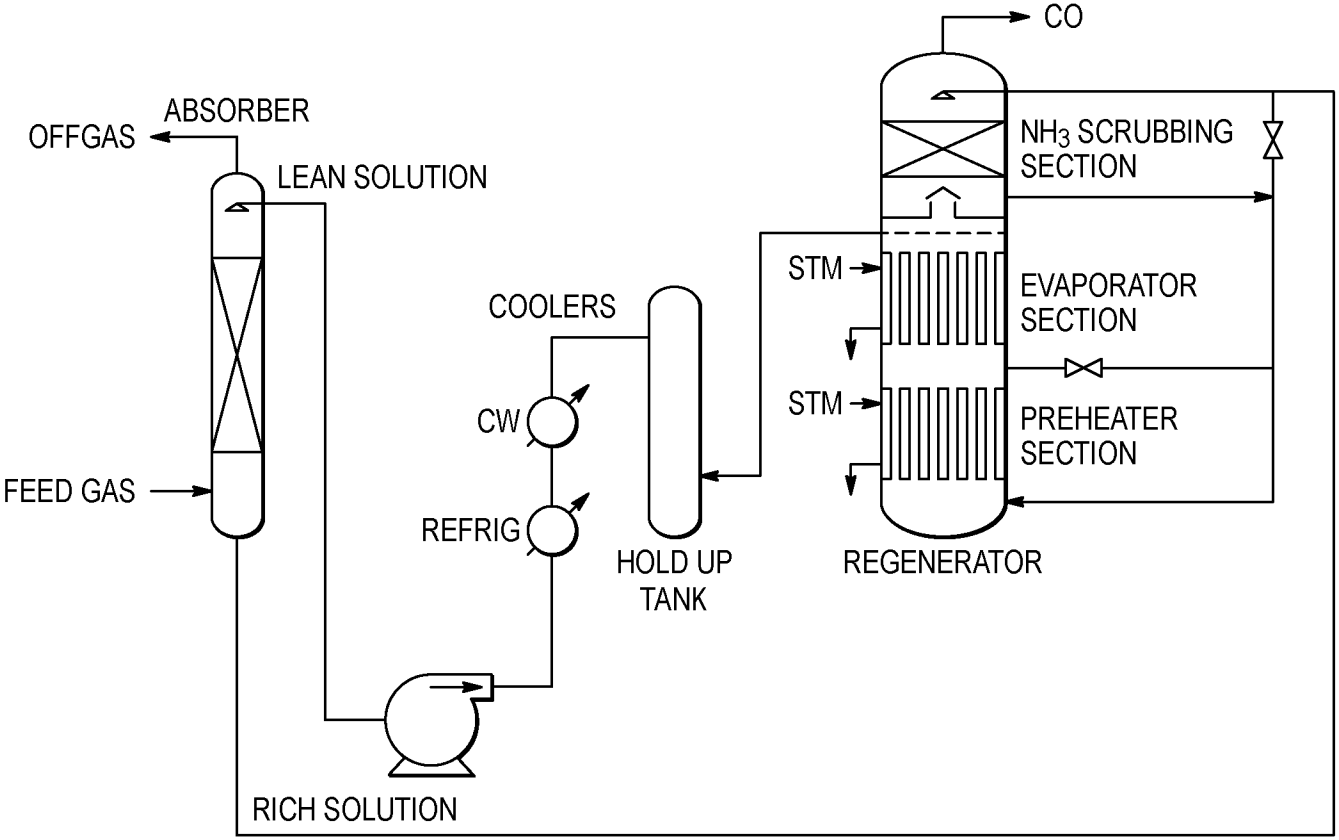
FIG. 5 is a schematic of a cuprous ammonium salt process for CO removal.

An embodiment of the SOEC, shown in FIG. 4B, includes two electrochemical cell designs (cathode|membrane|anode) which are used to reduce the endothermic load associated with electrochemical $CO_2$ reduction ($dH_{700°\ C.}$: +283.7 kJ/mol). Electrochemical half-cell and overall reactions associated with the proposed concept are shown in Equations 1-6. The first electrolyzer cell [Co—Ni/GDC (Eq. 1)|ScSZ|LSF-GDC (Eq. 2)] simultaneously converts $CO_2$ and $C_2H_6$ into CO and $C_2H_4$ reducing $CO_2$ reduction endothermicity (Eq. 3; $dH_{700° C.}$: +179.0 kJ/mol). Cell 2 (Eq. 6) [LSM/LSM-GDC (Eq. 4)|ScSZ|LSF-GDC (Eq. 5)] offsets both the voltage and heat requirements of Cell 1 (Eq. 3), while converting additional $C_2H_6$ into $C_2H_4$ and generating heat (Eq. 6; $dH_{700° C.}$: −103.7 kJ/mol). This two-cell combination dramatically reduces the endothermic heat load required for $CO_2$ reduction by ~75%, while lowering applied voltage required for $CO_2$ reduction. Alkenes ($C_2H_4$) generated at the anode may then be converted to chemicals/fuels (Eq. 7) using commercial oligomerization catalyst technology, yielding multiple valuable streams (CO, chemicals/fuels, and pipeline quality natural gas (PNG)).

| | |
|---|---|
| Cathode 1: CO2+2e -- >CO+O2- | Eq. 1 |
| Anode: C2H6+O2 -- >C2H4+H2O+2e- | Eq. 2 |
| Overall 1: C2H6+CO2->CO+C2H4+H2O; E700° C.: 0.09V | Eq. 3 |
| Cathode 2: 02+4e -- >202- | Eq. 4 |
| Anode: C2H6+02 -- >C2H4+H2O+2e- | Eq. 5 |
| Overall 2: C2H6+0.502->C2H4+H2O; E700° C.: +0.94V | Eq. 6 |
| Oligomerization: 4C2H4->C8H16 | Eq. 7 |

To assess the economic potential, the present inventor modified its existing SOFC and $CO_2$ capture Aspen Plus simulations to develop a process scheme to maximize $CO_2$ reuse [T. Tanim, D. J. Bayless, and J. P. Trembly, "Modeling of a 5 kWe tubular solid oxide fuel cell based system operating on desulfurized JP-8 fuel for auxiliary and mobile power applications," *J. Power Sources*, vol. 221, pp. 387-396, January 2013; T. Tanim, D. J. Bayless, and J. P. Trembly, "Modeling a 5 kWe planar solid oxide fuel cell based system operating on JP-8 fuel and a comparison with tubular cell based system for auxiliary and mobile power applications," *J. Power Sources*, vol. 245, pp. 986-997, January 2014; and R. Garlapalli, M. Spencer, K. Alam, and J. Trembly, "Integration of Heat Recovery Unit in Coal Fired Power Plants to Reduce Energy Cost of Carbon-dioxide Capture," *Appl. Energy*, vol. In review]. The study assumed a WNG throughput of 100 MMscf/day with a $C_2H_6$ content of 20%/balance $CH_4$. Using results from the Aspen Plus simulation, a preliminary process economic study for converting $CO_2$ into CO and $C_2H_6$ into gasoline was completed and breakeven required sales prices (RSP) were estimated. Stack power requirements were estimated assuming SOECs with 1 $m^2$/cell operating at a current density of 0.5 $A \cdot cm^{-2}$ were used. Cell 1 (Eq. 3) was assumed to operate at an applied voltage of 1.25V (0.85V to drive reaction and 0.4V of additional Joule heating to supply energy for the reaction, while Cell 2 (Eq. 6) was assumed to operate galvanically at 0.5V, yielding a total applied voltage of 0.75V/cell. SOEC stack costs were estimated to be $300/kW, while the remainder of costs were determined using Aspen Icarus costing software. A keep-whole contract method was used for the WNG processing, while a $CO_2$ cost ($40/ton) was assigned to $CO_2$ utilized from the carbon capture system at an existing coal-fired power plant. $CO_2$ stripping capital/operating costs were not included as these were considered part of the power plant's carbon capture system. Electrical power was assumed to be at a cost of $50/MWh.

Table 2 presents the estimated expense streams and required selling prices (RSPs) for the proposed product streams. The heating value for both products (CO and gasoline) were lumped together to determine the RSP ($/MMBtu). The current quoted price for bulk CO is 34.50 $/MMBtu for purity ranging from (98.0 to 99.99 vol %), while the price for gasoline is 26.31 $/MMBtu. The RSP for the proposed process products are 14.35 $/MMBtu. The primary reason for the large differences is associated with SOEC stack power and separation estimates used in this analysis. However, as long as the additional costs can be kept under 23.75 $/MMBtu, the proposed process can remain economically competitive (yielding 20% return on investment) based upon current CO and gasoline pricing. Thus, while it will be recognized by those of ordinary skill in the art that prices, values, dollar figures, etc. recited above and in Table 2 below are subject to change over time for myriad reasons, the analysis provided herein demonstrates the economic benefits of the invention described herein.

TABLE 2

Techno-economic Summary

| Parameter | Value |
|---|---|
| Wet Gas Feed (MMscf/day) | 100 |
| Composition (vol %) | 80-$CH_4$<br>20-$C_2H_6$ |
| Capacity Factor | 0.95 |
| Total Installed Capital ($MM) | 192 |
| Expenses | ($/day) |
| Cost of Capital | $57,810 |
| Cost of $CO_2$ ($40/ton) | $20,134 |
| SOEC Stack Power ($50/MWh) | $46,561 |
| Thermal Losses ($50/MWh) | $4,656 |
| Utilities | $25,726 |
| Operating Labor | $498 |
| Total Expenses | $155,386 |
| RSPs ($/MMscf) | $14.35 |

Additionally, the process, which is based upon a 100 MMscf/day WNG throughput, would generate approximately 9 MMscf/day CO, which is inline with commercial CO production facilities which range <0.5 MMscf/day upwards to 20 MMscf/day.

Another aspect of the present invention includes the ability to directly utilize flue gas as the $CO_2$ source for CO production. The CO product from the electrochemical cell in this case will contain $N_2$ requiring removal to generate a bulk CO product. Due to the similarity between CO and $N_2$ boiling points (−191.5° C. and −195.8° C., respectively), cryogenic partial condensation cannot be used. To remove CO from $N_2$, a complex containing cuprous ammonium salts of organic acids (CuAOC) is needed. CuAOCs form complexes with CO as shown in Eq. 8.

$$[Cu(NH_3)_2]^+ + CO + NH_3\,(aq) \rightarrow [Cu(NH_3)_3CO]^+ \qquad \text{Eq. 8}$$

Figure 1:
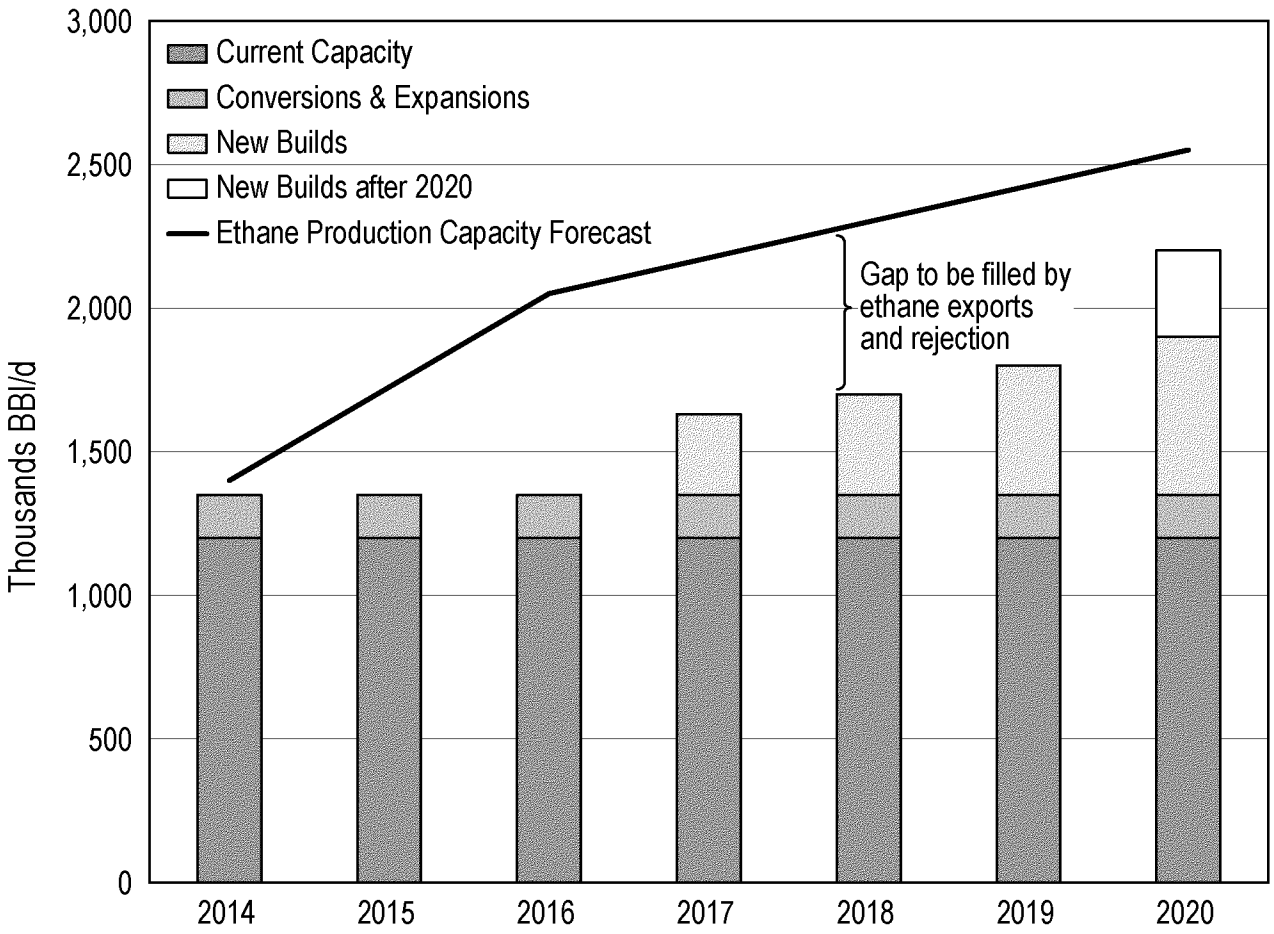
FIG. 1 is a graph of current and future U.S. ethane production and conversion capacities.
Figure 2:
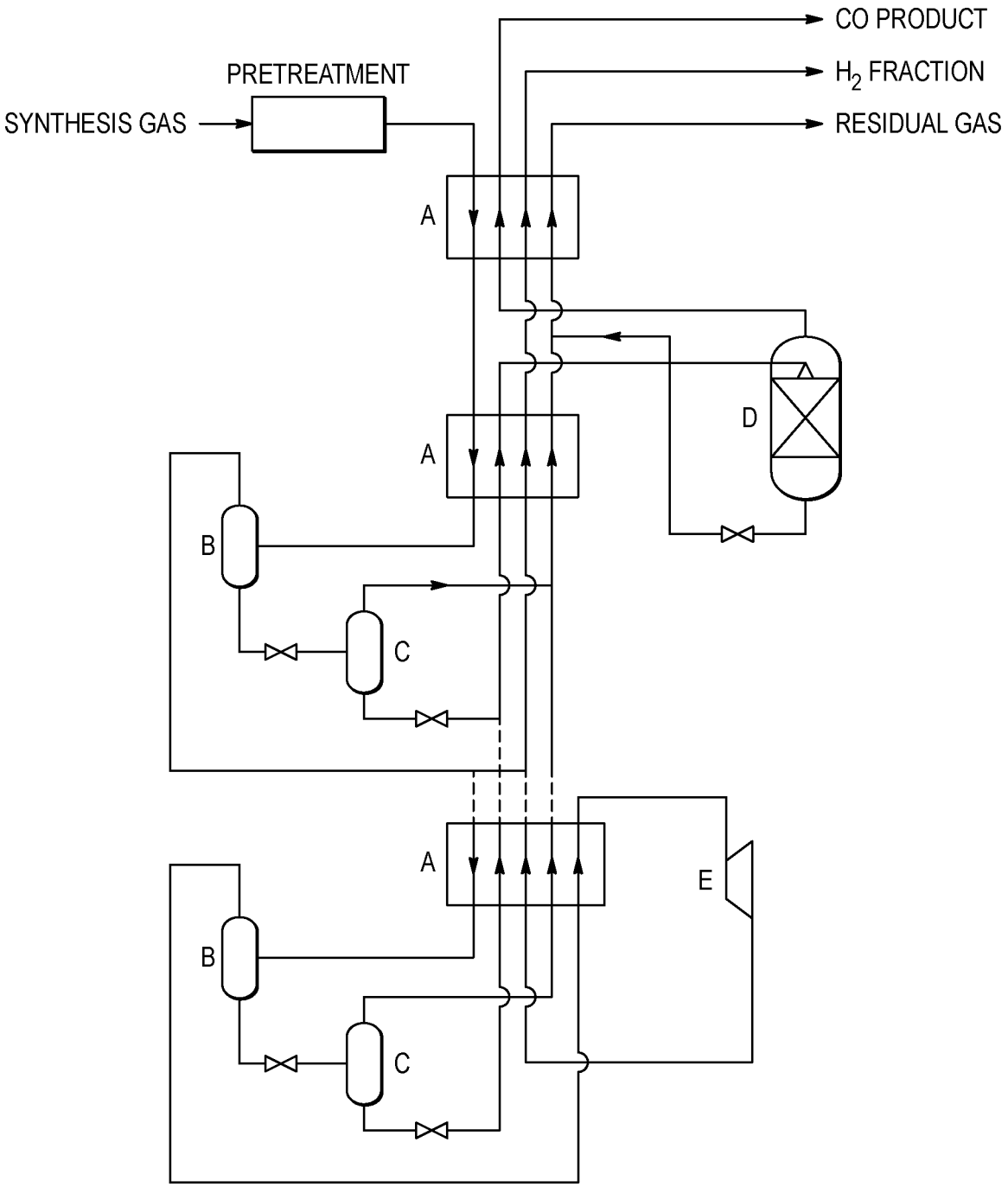
FIG. 2 is a schematic of bulk CO production using a cryogenic partial condensation process.
Figure 3A:
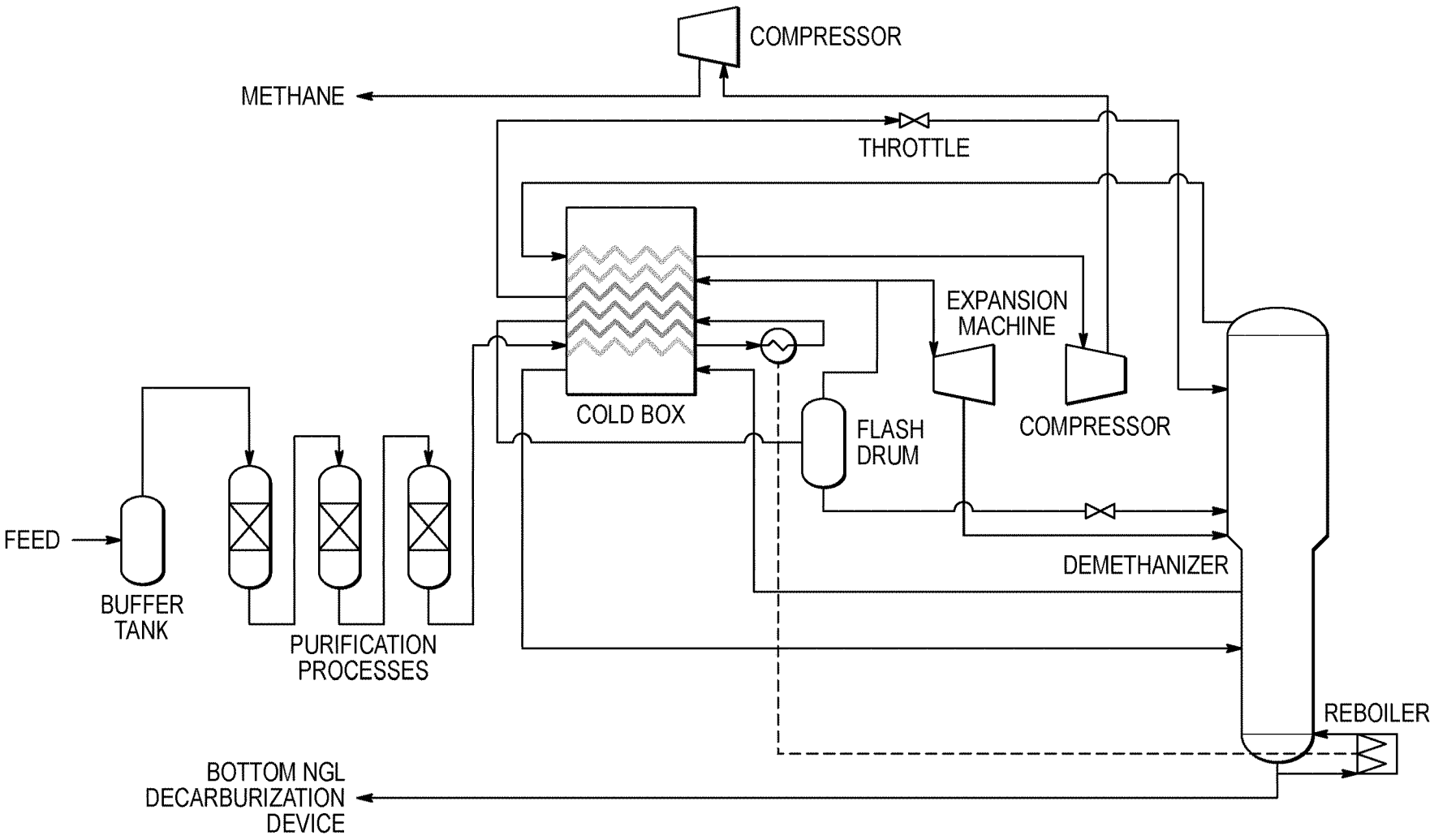
FIG. 3A is a schematic of a turbo-expander process for $C_{2+}$ separation from $CH_4$.
Figure 3B:
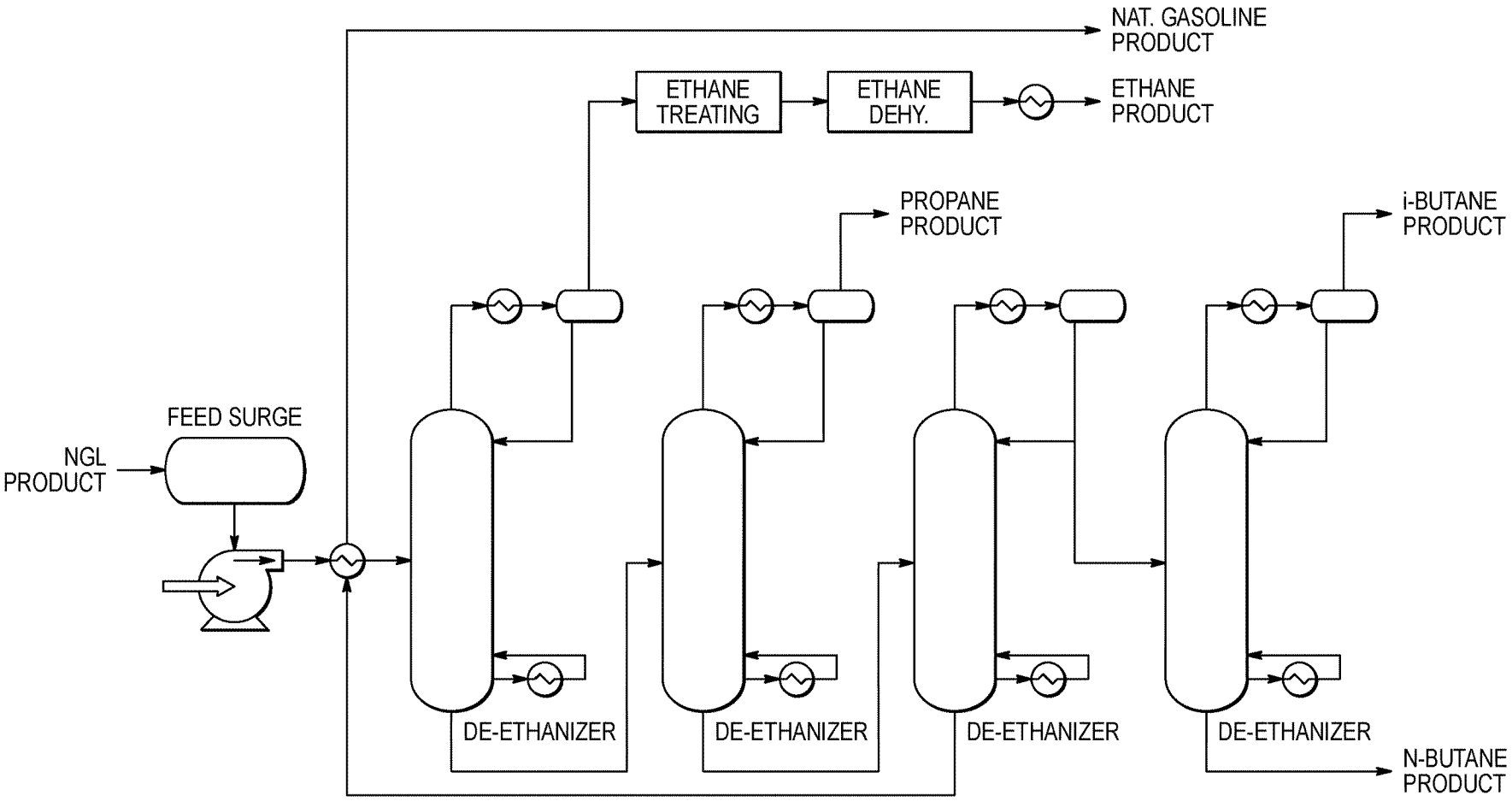
FIG. 3B is a schematic of a NGL fractionation train.

This type of process (FIGS. 3A and 3B) includes of an absorber operating between 82-110 bar and 15-32° C. is used to capture CO, where it is later released through regeneration of the solution at 1 bar and 80° C.

Figure 6:
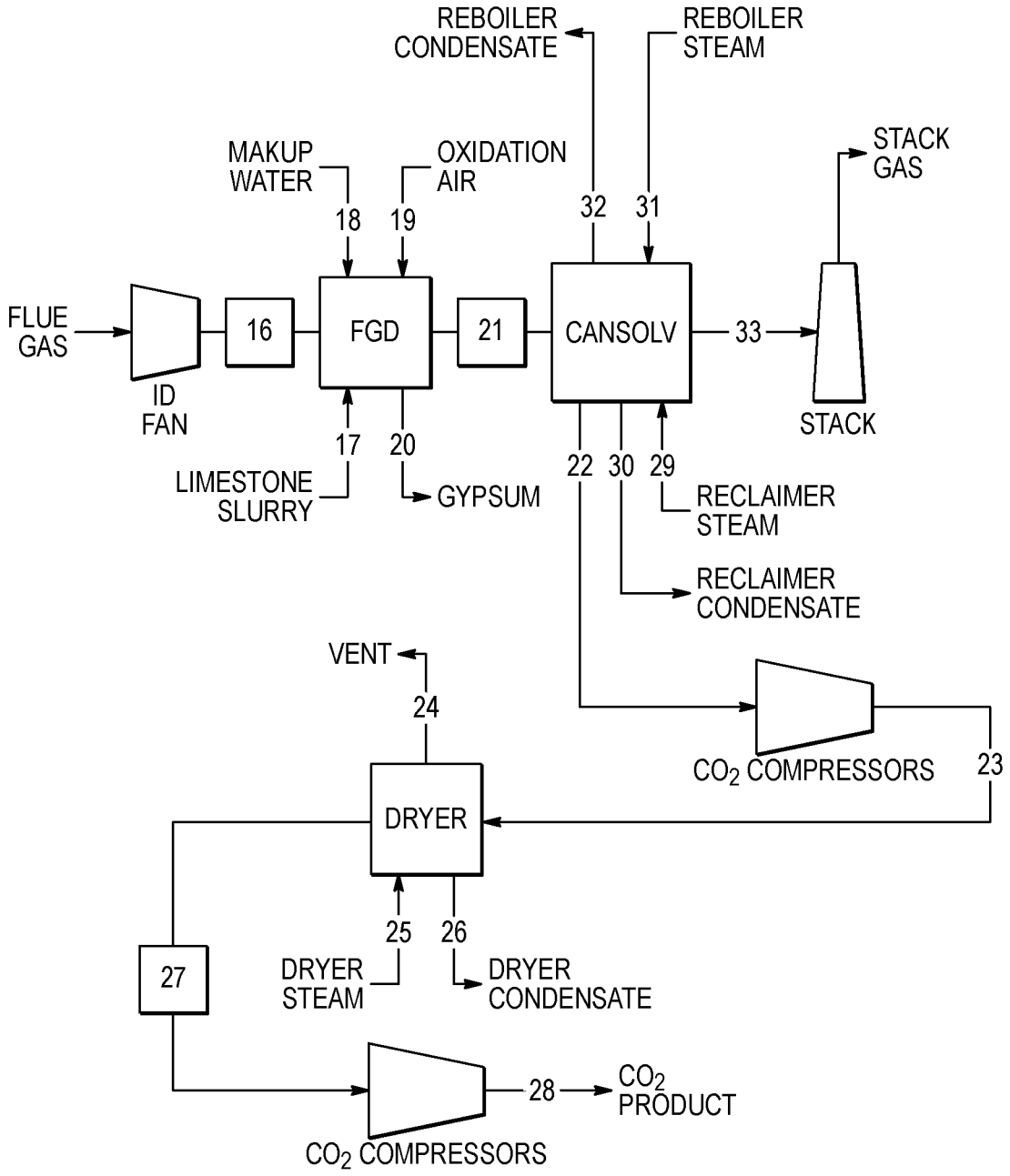
FIG. 6 is a schematic of a supercritical coal-fired power plant flue gas treatment train with $CO_2$ capture.

FIG. 6 presents environmental control unit operations for treatment of flue gas generated by a coal-fired power plant. Particulate removal has been assumed to have already been completed. the present inventor will evaluate integration of the proposed SOEC process upstream of the flue gas desulfurization (FGD) unit (Point-16), downstream of the FGD unit (Point-21), and downstream of $CO_2$ drying unit (Point-22). Each location has its own unique operating conditions and advantage/challenges as summarized in Table 3.

Details of the present inventor's intermediate-temperature SOEC-based $CO_2$ reuse process are described above. The ability to utilize SOEC technology to electrochemically convert $CO_2$ into $CO/O_2$ or $CO_2/H_2O$ into syngas/02 has been shown over recent years [F. Bidrawn, G. Kim, G. Corre, J. T. S. Irvine, J. M. Vohs, and R. J. Gorte, "Efficient Reduction of $CO_2$ in a Solid Oxide Electrolyzer," *Electro-*

*chem. Solid-State Lett.*, vol. 11, no. 9, pp. B167-6170, September 2008; L. Zhang, S. Hu, X. Zhu, and W. Yang, "Electrochemical reduction of $CO_2$ in solid oxide electrolysis cells," *J. Energy Chem.*, vol. 26, no. 4, pp. 593-601, July 2017; Y. Xie, J. Xiao, D. Liu, J. Liu, and C. Yang, "Electrolysis of Carbon Dioxide in a Solid Oxide Electrolyzer with Silver-Gadolinium-Doped Ceria Cathode," *J. Electrochem. Soc.*, vol. 162, no. 4, pp. F397-F402, January 2015; Z. Zhan, W. Kobsiriphat, J. R. Wilson, M. Pillai, I. Kim, and S. A. Barnett, "Syngas Production By Coelectrolysis of $CO_2$/$H_2O$: The Basis for a Renewable Energy Cycle," *Energy Fuels*, vol. 23, no. 6, pp. 3089-3096, June 2009; A. Maeda, K. Watanabe, T. Araki, and M. Mori, "Measurement and Numerical Simulation of Temperature Distributions of a Micro-Tubular SOEC during H2O/CO2 Co-Electrolysis," *ECS Trans., vol.* 78, no. 1, pp. 3113-3121, May 2017; and Pham, Wallman, and Glass, "Natural-Gas Assisted Steam Electrolyzer," 6,051,125]. However, challenges facing these applications are: (1) Large applied potential and endothermic heat load ($dH_{700°\ C.}$: +283.7 kJ/mol) associated with electrochemical reduction of $CO_2$; (2) expensive downstream gas-to-liquids conversion technology needed to convert syngas into fuels; and (3) single valuable product stream. Praxair has recently focused on converting $CO_2$ into CO utilizing a process based upon their oxygen transport membrane (OTM) technology. To partially alleviate potential/endothermic load issues, $CH_4$ was passed across the anode reducing endothermic heat load by ~⅔rd and reducing potential required to initiate $CO_2$ reduction [S. Allen, "Conversion of Waste $CO_2$ and Shale Gas to High Value Chemicals." July-2016; and J. A. Lane, G. M. Christie, and D. P. Bonaquist, "Electrochemical Carbon Monoxide Production," 8,591,718 B2]. However, challenges associated with this process include the high OTM operating temperature (850-1,000° C.), generation of $CO_2$ emissions at the anode, and production of a single valuable product stream (CO). Haldor Topsoe (HT) is now offering a similar technology, named eCOs™, which utilizes SOEC technology to generate on demand CO as the single valuable product stream [H. T. A/S (HQ), "Produce your own CO B'eCOs it's better|eCOs|$CO_2$ to CO|CO supplier|CO supply|CO onsite|CO plant." [Online]. Available: https://info.topsoe.com/ecos. [Accessed: 23 Jun. 2018]], though drawbacks with that technology exist, as well.

TABLE 3

Integration Location Conditions and Advantages/Challenges

| Location | Operating Conditions | Advantages | Challenges |
|---|---|---|---|
| Pre-FGD (16) | Comp: Flue gas (~8 vol % $H_2O$) Temp: 153° C. Press: 1.1 bar | Lower $H_2O$ content Better thermal integration Will lower $CO_2$ capture costs | Will require $SO_2$/$H_2O$/$O_2$ removal before $CO_2$ reduction Will require $SO_2$ removal |
| Post-FGD (21) | Comp: Flue gas (~15 vol % $H_2O$) Temp: 56° C. Press: 1.1 bar | SO2 already captured (some polishing may be necessary). Will lower $CO_2$ capture costs | Will require $H_2O$/$O_2$ removal before $CO_2$ reduction Lower thermal integration |
| $CO_2$ Product (27) | Comp: $CO_2$ (~1.5 vol % $H_2O$) Temp: 30° C. Press: 2.0 bar | No $SO_2$ processing needed Will offset $CO_2$ capture costs | Lower thermal integration Utilizes already captured $CO_2$ |

The present inventor's SOEC process advances beyond these previous electrochemical $CO_2$ reduction concepts by utilizing intermediate-temperature operation (650-750° C.) and utilizing an innovative two cell design (FIG. 4B) which generates multiple valuable product streams. Advancements the process include: (1) Intermediate temperature operation allowing for selective conversion of $C_2H_6$ in WNG mixtures; (2) Two cell design which reduces $CO_2$ reduction endothermic heat load by ~¾$^{ths}$ and reduces potential to initiate $CO_2$ reduction; (3) Produces multiple valuable product streams (CO, chemicals/fuels, and PNG) while generating little to no additional $CO_2$ emissions; and (4) Synergistically addresses key energy sector challenges including carbon capture costs and $C_2H_6$ oversupply.

As shown in Table 2, these advancements yield more favorable process economics in comparison to current state-of-the-art $CO_2$ reuse processes, increasing the likelihood of a new successful $CO_2$ reuse technology.

Figure 7A:
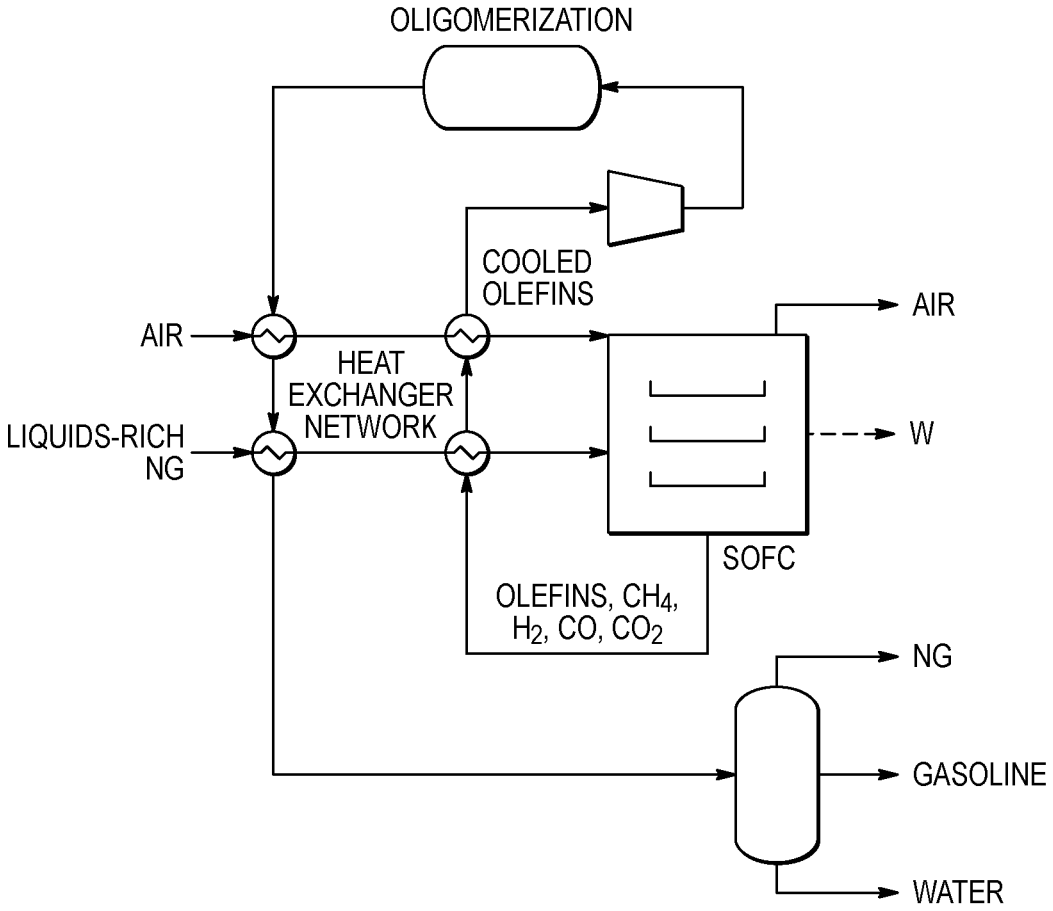
FIG. 7A is a schematic of a proposed e-ODH process.
Figure 7B:
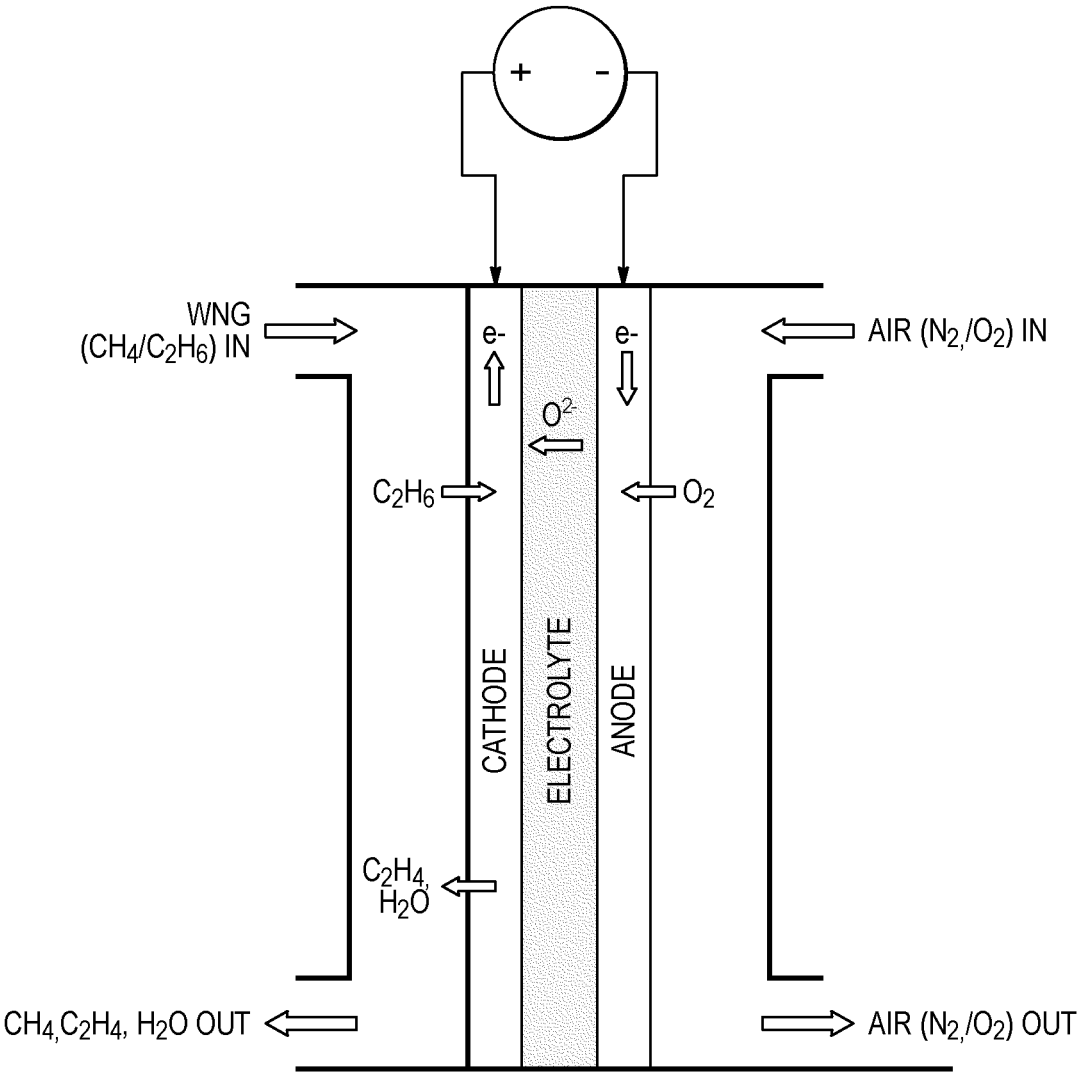
FIG. 7B is a schematic of SOFC for e-ODH of ethane.

Additionally, to address industry's need for better NGL management, and in another aspect of the present invention, the present inventor developed a modular electrogenerative oxidative dehydrogenation (e-ODH) process, shown in FIG. 7, which directly converts NGLs contained in WNG at the well-head into fungible fuels and pipeline-quality natural gas. In this process, NGLs contained in the well head gas are selectively converted into alkenes and byproduct electrical power using a solid oxide fuel cell (SOFC) module, followed by upgrading of the alkenes into gasoline range hydrocarbons and pipeline-quality natural gas in an oligomerization reactor. The primary e-ODH (other $C^{2+}$ alkanes are converted as well) and oligomerization reactions are shown in Equations 9-11 and Equation 12, respectively. The SOFC open cell potential (E) for Equation 11 at 700° C. with a feed containing 35 vol % ethane is 0.861 V.

| | |
|---|---|
| Anode: C2H6+O2- - > C2H4+H2O+2e- | Eq. 9 |
| Cathode: 02+4e- - > 202- | Eq. 10 |
| Overall: C2H6+0.502 -> C2H4+H2O | Eq. 11 |
| Oligomerization: 4C2H4 -> C8H16 | Eq. 12 |

Advantages offered by this e-ODH process include, but are not limited to, the following: (1) Modular operation at the well-head site providing a significantly lower capital and operating cost compared to steam cracking and advanced NGL conversion technologies; (2) Selectively converts NGLs contained in well-head gas without need for prior gas conditioning or separation and eliminating the need for energy intensive cryogenic separation; (3) Produces gasoline range hydrocarbons, pipeline-quality natural gas, and electrical power as products; (4) Utilizes existing SOFC and oligomerization reactor technology minimizing commercial adoption and market entry risk, and (5) Alleviates midstream gas separation capacity bottlenecks and reduces gas flaring and associated $CO_2$ emissions from associated gas.

TABLE 4

PNG Composition Specifications

| Component | Minimum (mol %) | Maximum (mol %) |
|---|---|---|
| Methane | 75 | None |
| Ethane | None | 10 |
| Carbon Dioxide | None | 3 |
| Diluent Gases | None | 5 |

Operating specifications for the e-ODH process have been developed based upon natural gas pipeline composition specifications in conjunction with current ethane separation costs charged by midstream processors such as MarkWest Energy Partners, Kinder Morgan, Blue Racer Midstream, etc. Performance specifications include e-ODH conversion criteria (product selectivities and ethylene yield) and anode overpotential. These properties assist in determining the ability of the product to be sold as pipeline-quality natural gas and overall operating costs for the proposed separation/conversion scheme. The solid oxide platform consists of a cathode-supported cell design composed of commercially available SOFC cathode and electrolyte materials. Dimensions for the cathode-supported cell design consist of a cathode, electrolyte, and anode with thicknesses of 500 μm, 20 μm, and 50 μm, respectively. Properties (conductivities, overpotentials, etc.) for commercially available cathode and electrolyte materials were used [T. Tanim, D. J. Bayless, and J. P. Trembly, *J. Power Sources*, vol. 245, pp. 986-997, January 2014]. Electrochemical stacks were assumed to consist of 120 cells, with each cell possessing 1,000 $cm^2$ of active area operating at 0.75 $A \cdot cm^{-2}$. Select natural gas pipeline specifications are shown in Table 4. Current ethane separation costs ($0.07/gal) were used in the assessment.

Figure 8:
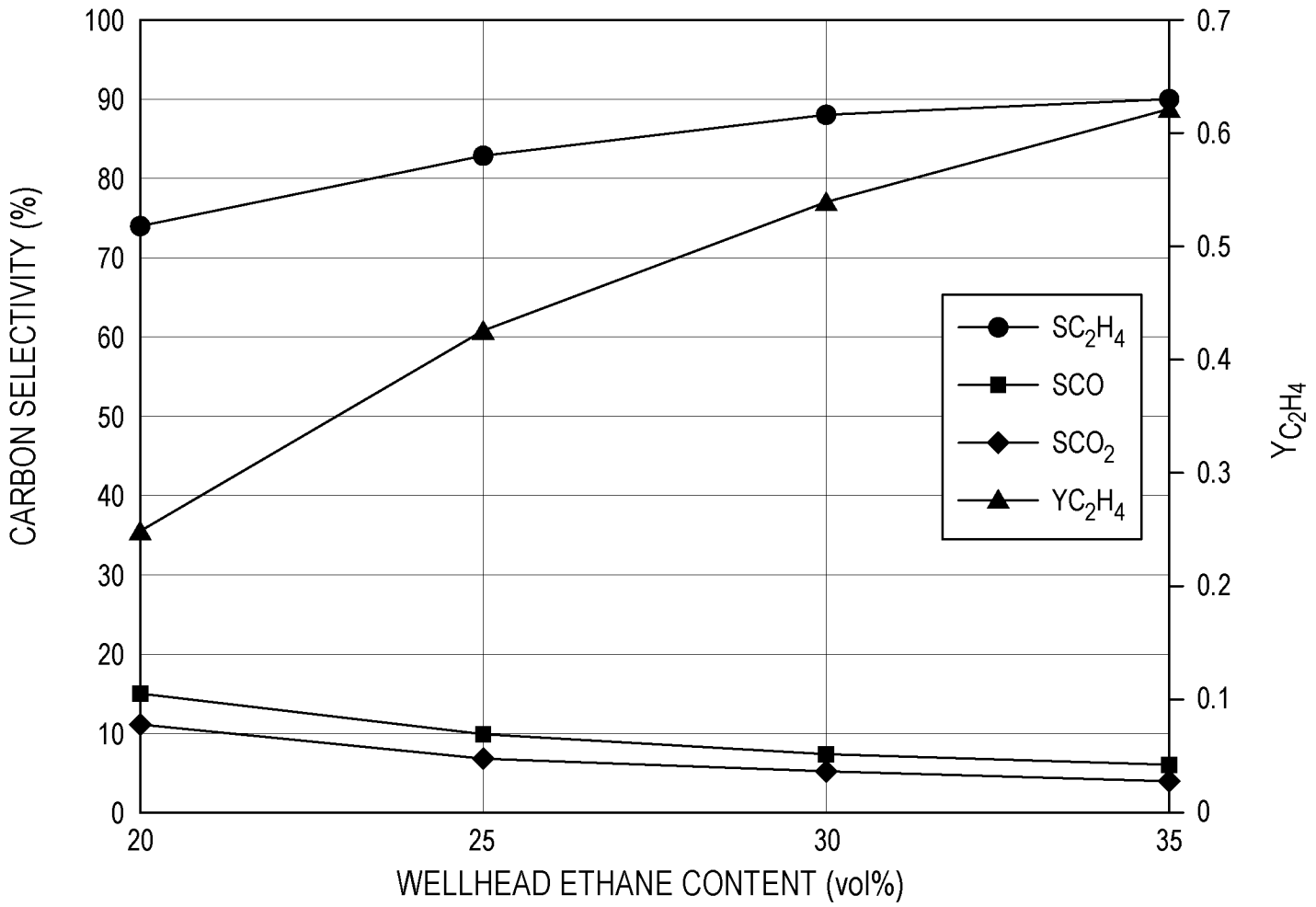
FIG. 8 is a graph of an e-ODH anode product carbon selectivities and ethylene yield.

Carbon selectivity for e-ODH products were determined to meet the maximum PNG ethane content specification of 10 mol % for 1 MMscf of well-head natural gas containing 20-35 mol % ethane/balance methane. It is assumed all ethylene product will be removed from the natural gas stream via downstream zeolite catalytic processing to fuels/chemicals. Based upon specified operating conditions approximately 8 electrochemical stacks would be required to process 1 MMscf/day of well-head gas containing 35 mol % ethane. FIG. 8 presents both e-ODH product selectivity and ethylene yield requirements for the process based upon well-head gas ethane content. Ethylene selectivity for the process is between 82-90%, based upon well-head gas containing 20-35% ethane. As ethane content in well-head gas increases, ethylene selectivity also increases to ensure pipeline natural gas composition specifications are met. This higher ethylene selectivity is used to control the concentration of carbon oxide (CO and $CO_2$) byproducts from competing reaction to meet pipeline specifications for these compounds. Ethylene yield requirements for the e-ODH process were found not to be as stringent (0.25-0.62), as ethane conversion requirements are limited due to a maximum pipeline natural gas content of 10 mol %.

Power necessary to operate the proposed e-ODH process is also a factor. To assess the maximum acceptable anode overpotential, an existing SOFC model developed by the present inventor was modified [T. Tanim, D. J. Bayless, and J. P. Trembly, J. Power Sources, vol. 245, pp. 986-997, January 2014; and T. Tanim, D. J. Bayless, and J. P. Trembly, *J. Power Sources*, vol. 221, pp. 387-396, January 2013], which equates ethane separation costs to the solid oxide electrochemical cell power requirement (Equations 13-17), $$(ESP)(DF) = (V \times I)\left(\frac{1\text{ hr}}{3600\text{ s}}\right)(EP) \quad \text{Eq. 13}$$

$$-V = E - \eta_{act} - \eta_{ohm} - \eta_{conc} \quad \text{Eq. 14}$$

$$\eta_{act} = \eta_{anode} - \eta_{cathode} \quad \text{Eq. 15}$$

$$\eta_{ohm} = (\rho_a l_a + \rho_e l_e + \rho_c l_c) \times j \quad \text{Eq. 16}$$

$$\eta_{conc} = 0 \quad \text{Eq. 17}$$

where ESP is the ethane separation cost ($0.07/gal), DF is the discount factor (0.8), V is the fuel cell operating voltage, I is the current associated with conversion of 1 gallon of ethane per second, EP is the electricity price (0.0676 $/kWh), E is the open cell potential at 700° C. with 35 mol % ethane in the well-head gas (0.861 V), η are the activation (anode and cathode), ohmic, and concentration overpotentials respectively, ρ are the resistivity values for the anode, electrolyte, and cathode at 700° C., and l are the anode, electrolyte, and cathode thicknesses, respectively. Open cell potential for the e-ODH cell was found to be 0.861 V. A cell operating voltage of −0.343 V was found, yielding an anode overpotential of 0.740 V, with ohmic and cathode overpotentials of 0.178 V and 0.286 V, respectively.

TABLE 5

Preliminary e-ODH Process Techno-economic Study Results

| Parameter | Value | |
|---|---|---|
| NGL feed rate (MMscf/day) | 5 | 5 |
| NGL composition (vol. %) | 65-$CH_4$ 35-$C_2H_6$ | 80-$CH_4$ 20-$C_2H_6$ |
| Fuel Utilization (%) | 90 | 82 |
| Capacity Factor | 0.95 | 0.95 |
| Total Installed Capital ($ MM) | 9.2 | 9.2 |
| Product | (bbl/day) | (bbl/day) |
| Gasoline | 404 | 211 |
| Expenses | ($/day) | ($/day) |
| Cost of Capital | $9,754 | $9,754 |
| Electricity ($0.0656/kWh) | $2,200 | $1,150 |
| Utilities | $1,286 | $1,286 |
| Operating Labor | $910 | $910 |
| Total Expenses | $14,150 | $13,100 |
| RSP ($/gal) | 0.833 | 1.47 |

The present inventor has developed an Aspen Plus® simulation and completed a preliminary techno-economic analysis of the proposed e-ODH process to take into account the wide range of ethane content found across operating hydrocarbon reservoirs and well lifetime. The study was completed utilizing a well-head gas production rate of 5 MMscf/d containing between 20-35 vol % ethane. A keep-whole contract method was used for the ethane processing, while a 3-year term at 10% APR was used for the cost of capital. To simplify the SOFC module all NGLs were modeled as ethane. The SOFC module was assumed to operate between 82-90% percent fuel utilization (based upon well-head gas ethane content and pipeline specifications)

with a cost of $3,000/kW. The e-ODH system was assumed to operate electrolytically with an applied voltage of 0.343 V per cell (as derived above). Aspen Icarus was used to develop capital costs for the other major equipment items shown in FIG. 7. A summary of the techno-economic study results is shown in Table 5. Total installed capital for the e-ODH process is approximately $9.2 million, producing between 211-404 BBl/d of gasoline, consuming 0.73-1.40 MWe, and generating 3.43-4.17 MMscf/d of pipeline-quality natural gas. Utilities (catalyst replacement, cooling water, etc.) were estimated from material balances and operating labor based upon chemical engineering cost factors. The required selling price (RSP) for the gasoline product was found to range from 0.83-1.47 $/gal compared to current C8H16 bulk pricing of 2.68 $/gal. A capital cost of $22.7-43.6 k/bbl·d was estimated. Under similar gas pricing, capital costs for gas-to-liquid plants are $60-85 k/bbl·d, indicating the e-ODH process potentially provides a significant economic opportunity for liquids-rich shale and associated gas producers.

EXAMPLES

Example 1

Electrochemical Conversion of $CO_2$ to CO

Figure 9:
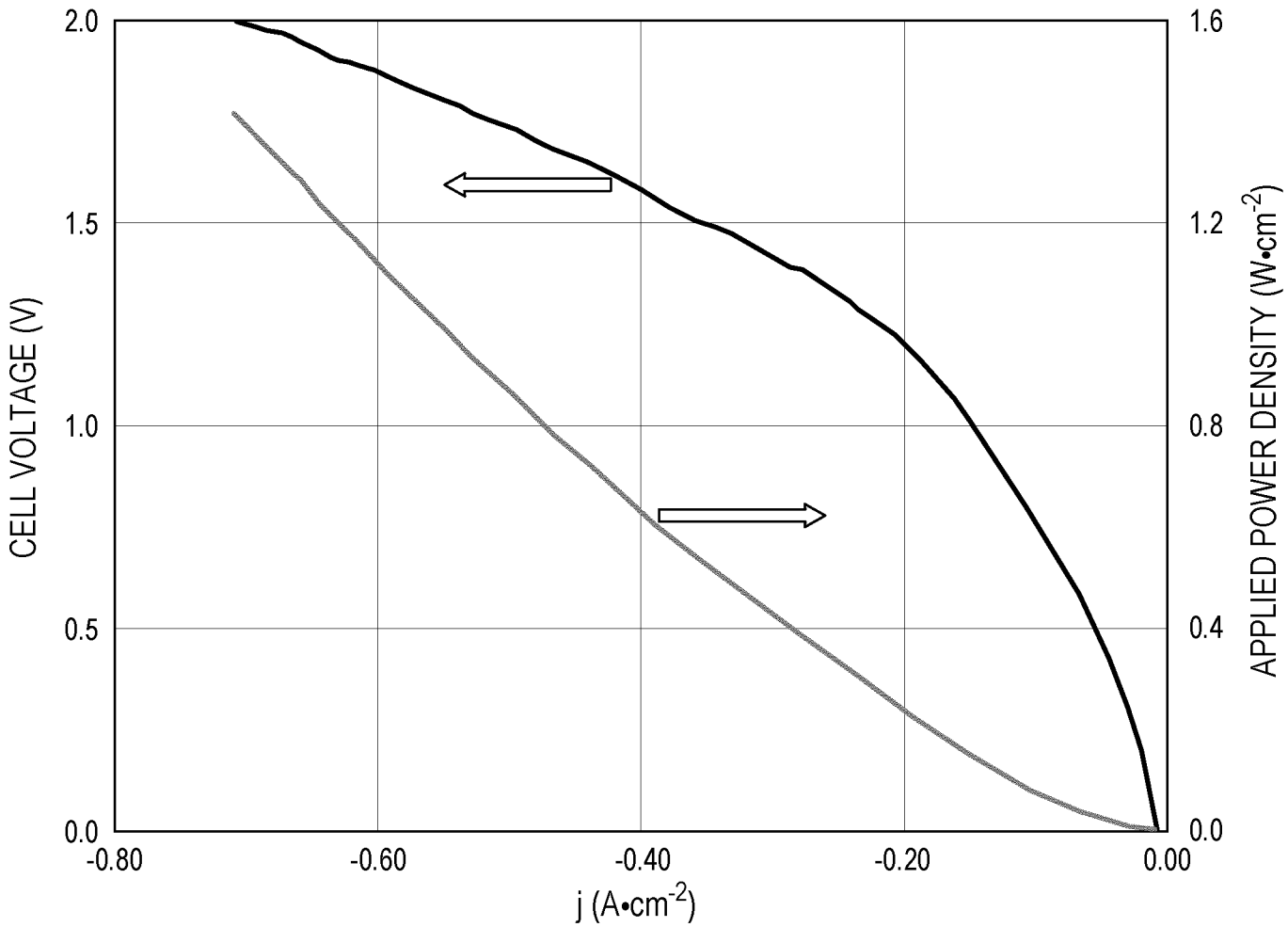
FIG. 9 is a graph of V-j and power density curves for the inventor's SOEC for $CO_2$ electrolysis at 750° C. with applied voltage of 0-2V. Cathode gas consisted of 50% $CO_2$, 45% Ar, balance $H_2$.

The present inventor has conducted laboratory trials to demonstrate the ability to electrochemically reduce $CO_2$ at intermediate temperature (750° C.). The SOEC consisted of a scandia stabilized zirconia (SsSZ) membrane, LSM/LSM-GDC anode for oxygen evolution, and cathode made of a porous GDC scaffold with infiltrated Ni catalyst (~40 wt %). FIG. 9 presents results using a Ni-GDC cathode for electrochemical $CO_2$ reduction. While operating at 0.5 A·cm-2 the unoptimized Ni-GDC electrode required an applied potential of 1.7V. Further, at these conditions the SOEC converted up to 10% of $CO_2$ at a Faradic efficiency of approximately 68%. These preliminary results when compared to previous studies indicates an infiltrated catalyst has great potential to improve electrochemical $CO_2$ reduction performance at intermediate temperatures [Y. Xie, J. Xiao, D. Liu, J. Liu, and C. Yang, "Electrolysis of Carbon Dioxide in a Solid Oxide Electrolyzer with Silver-Gadolinium-Doped Ceria Cathode," *J. Electrochem. Soc.*, vol. 162, no. 4, pp. F397-F402, January 2015; P. Kim-Lohsoontorn and J. Bae, "Electrochemical performance of solid oxide electrolysis cell electrodes under high-temperature coelectrolysis of steam and carbon dioxide," *Proc.* 2010 *Eur. Solid Oxide Fuel Cell Forum*, vol. 196, no. 17, pp. 7161-7168, September 2011; and L. Zhang, S. Hu, X. Zhu, and W. Yang, "Electrochemical reduction of $CO_2$ in solid oxide electrolysis cells," *J. Energy Chem.*, vol. 26, no. 4, pp. 593-601, July 2017].

Recent first principles studies of high temperature SOEC $CO_2$ electrolysis at 700° C. indicate Ru, Co, and Ni are the best suited transition metals for this application, with Co possessing the best balance between electrolysis rate and oxygen binding energy at its surface [X.-K. Gu, J. S. A. Carneiro, and E. Nikolla, "First-Principles Study of High Temperature $CO_2$ Electrolysis on Transition Metal Electrocatalysts," *Ind. Eng. Chem. Res.*, vol. 56, no. 21, pp. 6155-6163, May 2017]. The study showed Co's hexagonal closed packed (HCP) crystal structure is an ideal candidate for $CO_2$ electrolysis. Another innovation of the present invention is to develop Co—Ni alloy electrocatalyst for $CO_2$ reduction as such alloys can form HCP crystal structures to reduce required applied potential and improve overall process performance [M. Spasojevic, L. Ribic-Zelenovic, and A. Maricic, "The Phase Structure and Morphology of Electrodeposited Nickel-Cobalt Alloy Powders," *Sci. Sinter.*, vol. 43, no. 3, pp. 313-326, December 2011]. Maintaining HCP metal crystal structure at typical SOEC operating conditions is difficult as the metal naturally transitions to the face centered cubic (FCC) structure. However, researchers have shown HCP Co-based nanoparticles can be formed and can maintain their structure at temperatures up to 700° C. This is possible when using CO as the reducing gas, causing Co particles to be coated by a graphitic layer which decreases the Co's surface energy, inhibiting phase change [V. A. de la Pena O'Shea, P. Ramirez de la Piscina, N. Homs, G. Aromi, and J. L. G. Fierro, "Development of Hexagonal Closed-Packed Cobalt Nanoparticles Stable at High Temperature," *Chem. Mater.*, vol. 21, no. 23, pp. 5637-5643, December 2009]. As the ability to electrocatalytically reduce $CO_2$ using a cathode infiltrated with Ni-based catalyst has been shown (FIG. 9), the present inventor improves $CO_2$ reduction overpotential at intermediate temperature (650-750° C.) by incorporating infiltrated Co—Ni alloys with HCP structure, which are stabilized utilizing CO-based reduction methodologies.

Example 2 e-ODH of Ethane

Figure 10:
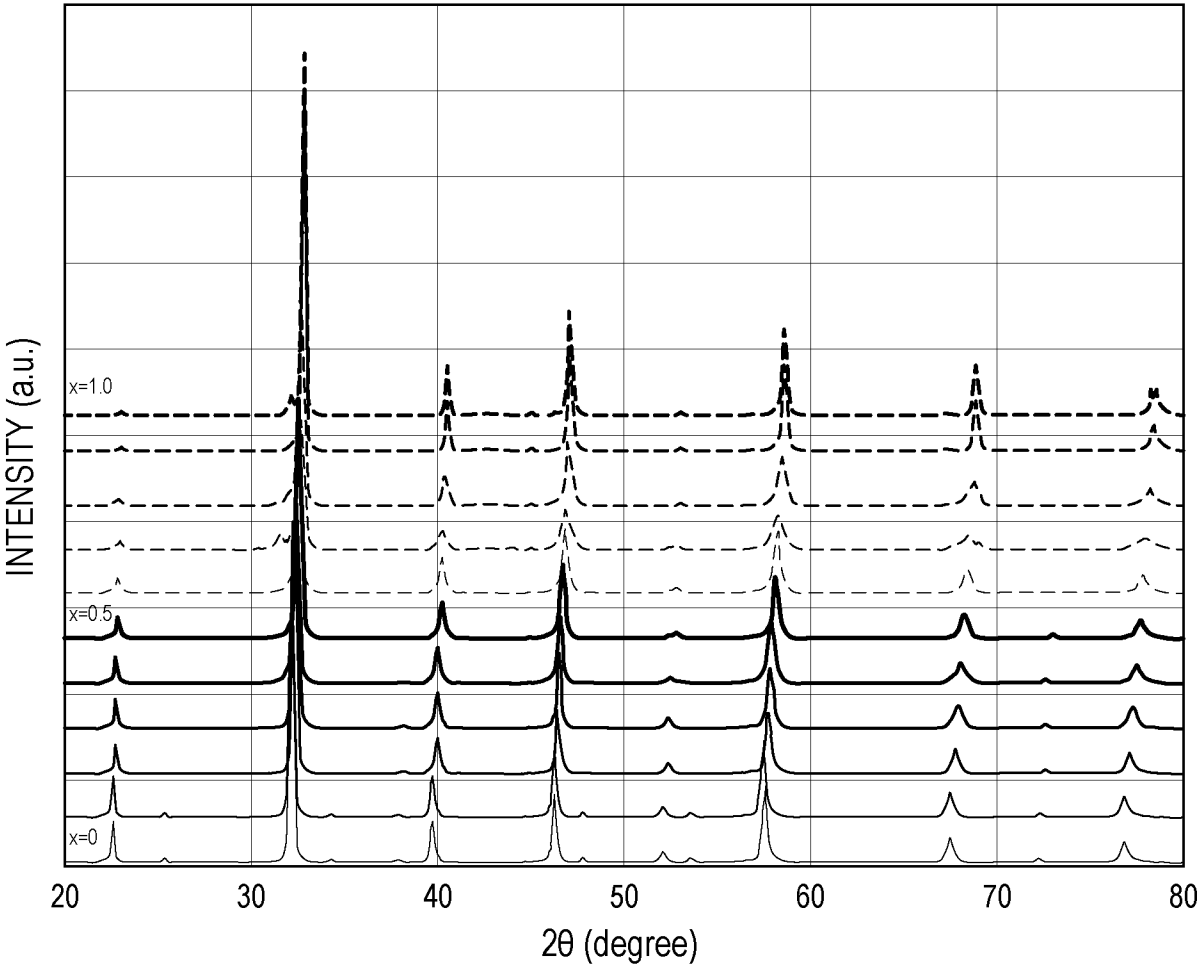
FIG. 10 is a graph representing XRD and oxygen vacancy and deficiency (δ) for $La_{1-x}Sr_xO_{3-\delta}$ electrocatalysts synthesized using modified Pechinni method with x=0-1.0.

The present inventor has been developing e-ODH electrocatalysts for the selective conversion of $C_2H_6$ to $C_2H_4$ in a natural gas matrix. A thorough literature review showed that lanthanum strontium iron-La1-xSrxO3-δ (LSF) perovskites possesses promising stability and high $C_2H_4$ selectivity in a reducing environment. FIG. 10 (in conjunction with Table 6, below) shows XRD data for several LSF catalysts synthesized by the present inventor and their associated oxygen deficiency (6) determined using thermal gravimetric analysis. Comparing the XRD spectra with literature showed the present inventor's synthesis method is able to successfully produce single phase perovskites and the catalyst materials possess oxygen vacancies necessary for conducting oxide ions ($O^{2-}$) generated from $CO_2$ reduction, to complete oxidative dehydrogenation of $C_2H_6$.

TABLE 6

| Sample | Oxygen Vacancy (%) | | Formula |
|---|---|---|---|
| LSF0 | 0.54 | 0.082 | LaFeO3-0.082 |
| LSF0.1 | 0.9 | 0.133 | Lao.9Sro.1FeO3-0.133 |
| LSF0.2 | 1.38 | 0.199 | Lao.8Sro.2FeO3-0.199 |
| LSF0.3 | 1.61 | 0.230 | Lao.7Sro.3FeO3-0.230 |
| LSF0.4 | 1.97 | 0.293 | La0.6Sro.4FeO3-0.293 |
| LSF0.5 | 2.55 | 0.346 | La0.5Sro.5FeO3-0.346 |
| LSF0.6 | 3.58 | 0.474 | Lao.4Sro.6FeO3-0.474 |
| LSF0.7 | 4.88 | 0.631 | Lao.3Sro.7FeO3-0.631 |
| LSF0.8 | 4.42 | 0.549 | Lao.2Sro.8FeO3-0.549 |
| LSF0.9 | 5.33 | 0.656 | Lao.1Sro.9FeO3-0.656 |
| LSF 1 | 3.65 | 0.438 | SrFeO3-0.438 |

Figure 11A:
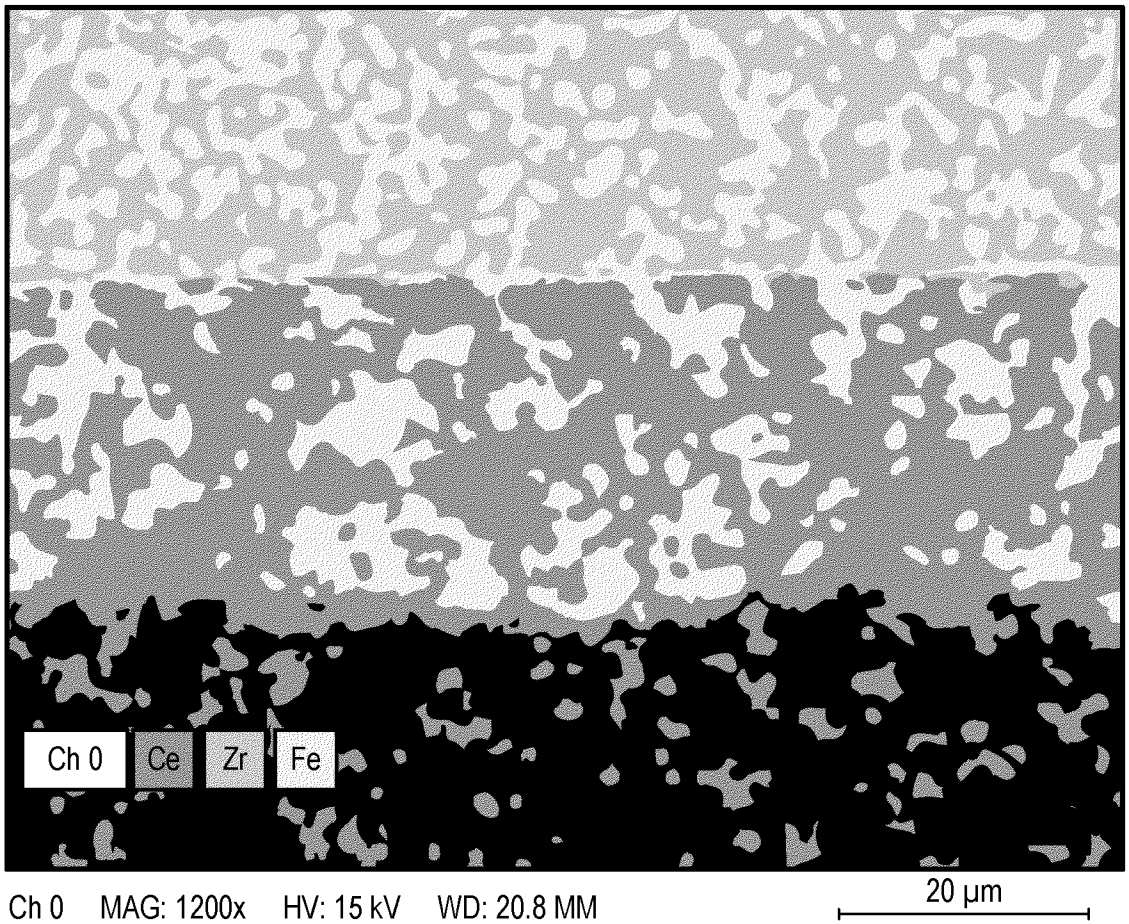
FIG. 11A is a photograph representing LSF0.9/GDC SEM/EDS cross section analysis.
Figure 11B:
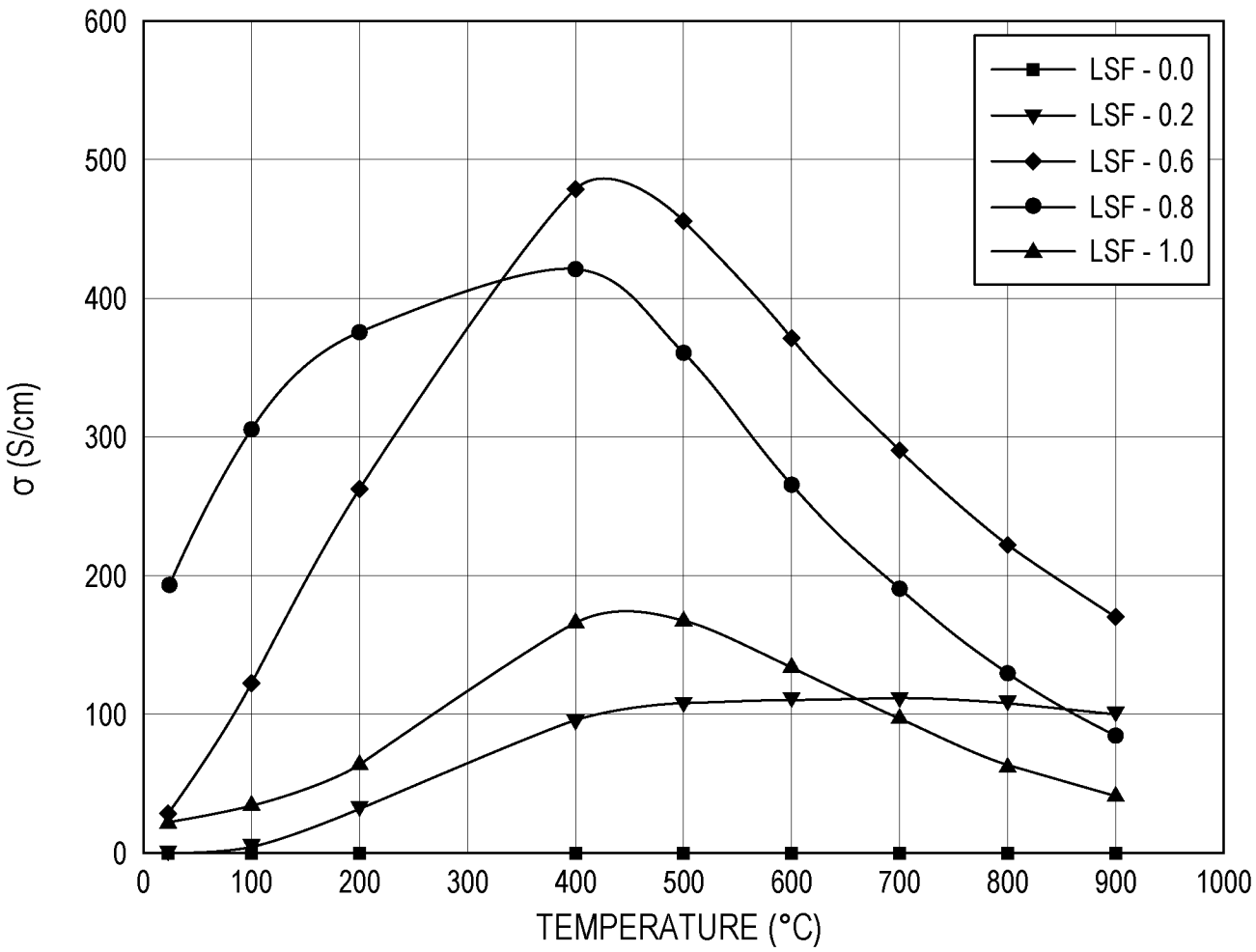
FIG. 11B is a graph representing total conductivity data for select LSF materials.
Figure 12A:
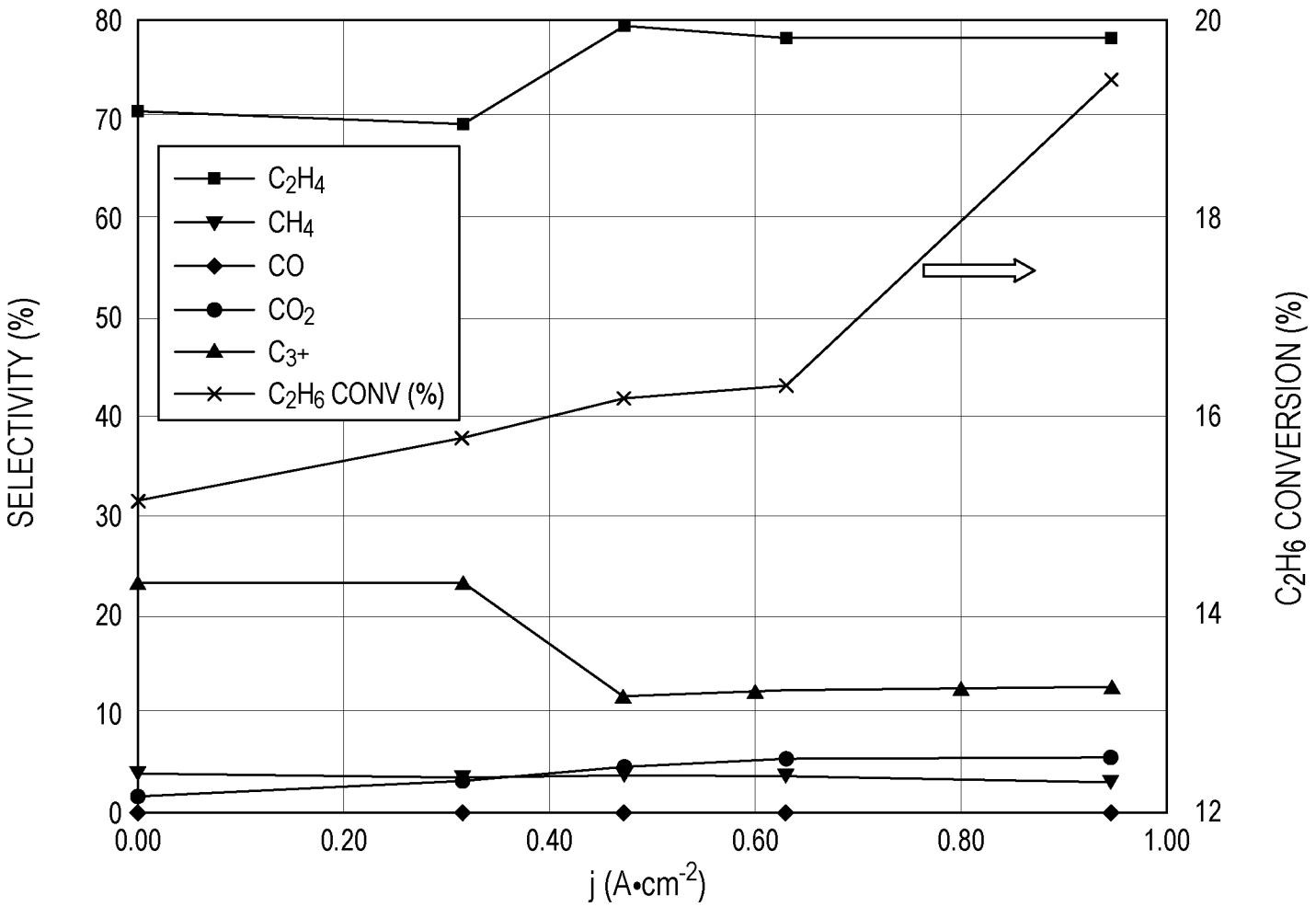
FIG. 12A is a graph representing LSF0.9-GDC anode e-ODH selectivities and $C_2H_6$ conversion at 650° C.
Figure 12B:
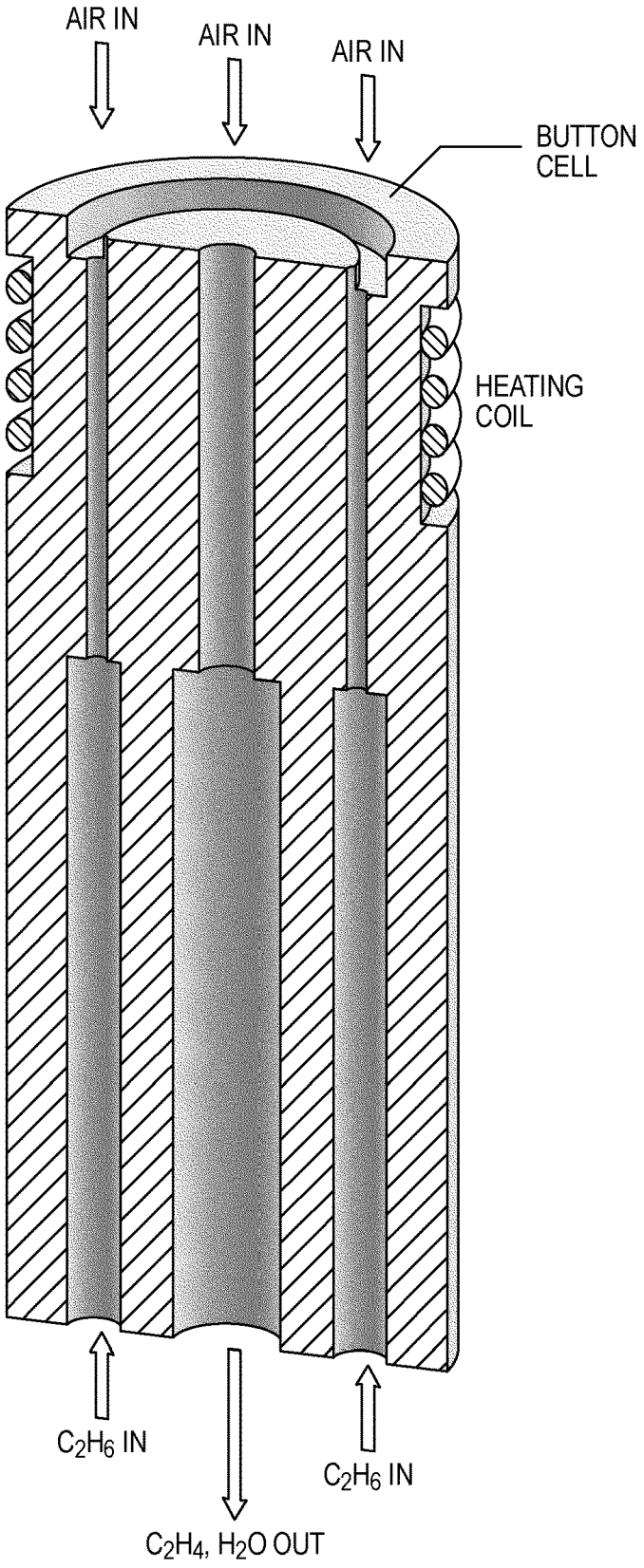
FIG. 12B is a view of a cell test fixture to minimize residence time.

LSF0.9 (with the greatest oxygen vacancy) was selected for the present inventor's initial e-ODH tests. The first button cells for electrochemical tests were made with an LSM/LSM-GDC cathode, commercial ScSZ membrane, and pure LSF0.9 catalyst screen printed anode. Initial results with this anode were poor, likely due to an insufficient triple phase boundary at the anode/membrane interface. To improve performance, the LSF0.9 catalyst was mixed with GDC (50/50 mass ratio) and screen printed on the same membrane/cathode combination. FIG. 11A presents an SEM/EDS cross-sectional analysis of the present inventor's LSF0.9/GDC anode, along with measured total electrical conductivity data for select LSF catalysts. The cross-section image shows good mixing between LSF0.9 and GDC with sufficient adherence to the electrolyte. The target total electrical conductivities for anodes material in SOFC reported in the literature is 100 S/cm with the lowest limit being 1 S/cm [J. W. Fergus, "Oxide anode materials for solid oxide fuel cells," *Solid State Ion*., vol. 177, no. 17, pp. 1529-1541, July 2006]. This fuel cell was mounted to a specially designed alumina test fixture which minimized gas residence time (FIG. 12B), thereby minimizing thermal cracking of $C_2H_6$ allowing for e-ODH performance to be determined. e-ODH results with the LSF0.9-GDC anode are shown in FIG. 12A. The results reported here have been corrected for the limited thermal cracking associated with the system. To achieve these current densities the cell was operated electrolytically applying up to 2 V as neither electrode is optimized. Preliminary results with LSF0.9 electrocatalyst show promising $C_2H_4$ selectivity of nearly 80%, compared to thermal cracking conversion and selectivity of 2% and 57.5%, respectively.

An innovation proposed by the present inventor is to selectively complete e-ODH of $C_2H_6$ in WNG with limited $CH_4$ conversion. By operating the e-ODH cell at intermediate temperature (650-750° C.), selective $C_2H_6$ conversion in a $CH_4$ matrix is feasible due to $C_2H_6$'s significantly higher activity at these temperatures in comparison to $CH_4$ [M. Younessi-Sinaki, E. A. Matida, and F. Hamdullahpur, "Kinetic model of homogeneous thermal decomposition of methane and ethane," *Int. J. Hydrog. Energy*, vol. 34, no. 9, pp. 3710-3716, May 2009; Y. Hidaka, K. Sato, Y. Henmi, H. Tanaka, and K. Inami, "Shock-tube and modeling study of methane pyrolysis and oxidation," *Combust. Flame*, vol. 118, no. 3, pp. 340-358, August 1999; and Y. Hidaka et al., "Shock-tube and modeling study of ethane pyrolysis and oxidation," *Combust. Flame*, vol. 120, no. 3, pp. 245-264, February 2000]. And so, an aspect of the present invention is to develop an e-ODH anode to have high $C_2H_6$ activity at intermediate temperature with $C_2H_6$ selectivity >90% and low overpotential. These goals are feasible based upon the encouraging preliminary experimental results already obtained by the present inventor. When considering direct utilization of flue gas as the $CO_2$ source, the impact of $SO_2$ must be considered as metal catalysts such as Co and Ni are prone to $SO_2$ poisoning. A DRIFT study on Co and Ni metals and alloys showed the consumption of OH— functional groups on the metals to form sulfates. Interestingly, both pure Co and Co—Ni alloy with higher Co content were found to be more resistant to $SO_2$ poisoning than pure Ni and higher Ni content alloy [F. J. P. Gómez, "MECHANISM OF SULFUR POISONING BY $H_2S$ AND $SO_2$ OF NICKEL AND COBALT BASED CATALYSTS FOR DRY REFORMING OF METHANE." March-2016]. Further conversion of alkenes to chemicals/fuels is an efficient and well documented process with technology packages offered by several catalyst manufacturers [A. Hwang et al., "Low Temperature Oligomerization of Ethylene over Ni/Al-KIT-6 Catalysts," *Catal. Lett*., vol. 147, no. 6, pp. 1303-1314, June 2017; R. D. Andrei, M. I. Popa, F. Fajula, and V. Hulea, "Heterogeneous oligomerization of ethylene over highly active and stable Ni-AISBA-15 mesoporous catalysts," *J. Catal*., vol. 323, pp. 76-84, March 2015; B. H. Babu, M. Lee, D. W. Hwang, Y. Kim, and H.-J. Chae, "An integrated process for production of jet-fuel range olefins from ethylene using Ni-AISBA-15 and Amberlyst-35 catalysts," *Appl. Catal. Gen*., vol. 530, pp. 48-55, January 2017; S. Moon, H.-J. Chae, and M. B. Park, "Oligomerization of light olefins over ZSM-5 and beta zeolite catalysts by modifying textural properties," *Appl. Catal. Gen*., vol. 553, pp. 15-23, 2018; S. Lin et al., "Tuning the pore structure of plug-containing Al-SBA-15 by post-treatment and its selectivity for $C_{16}$ olefin in ethylene oligomerization," Microporous Mesoporous Mater., vol. 184, pp. 151-161, January 2014; and S. Moussa, M. A. Arribas, P. Concepción, and A. Martinez, "Heterogeneous oligomerization of ethylene to liquids on bifunctional Ni-based catalysts: The influence of support properties on nickel speciation and catalytic performance," *Sel. Pap. 6th Czech-Ital.-Span. Conf. Mol. Sieves Catal. Amantea Italy Jun.* 14 17 2015, vol. 277, pp. 78-88, November 2016].

Example 3

Industrial CO production is an energy intensive process due to the highly endothermic steam-methane reaction (SMR) used to generate $H_2$/CO and the necessary cryogenic (cold box) process to separate CO from $H_2$. Studies estimating $CO_2$ emissions associated with SMR-based $H_2$ production are plentiful with a reported range of 9.71-12 kg $CO_2$/kg $H_2$ [F. Suleman, I. Dincer, and M. Agelin-Chaab, "Comparative impact assessment study of various hydrogen production methods in terms of emissions," *Spec. Issue Prog. Hydrog. Prod. Appl. ICH2P*-2015 3-6 *May* 2015 *Oshawa Ont. Can*., vol. 41, no. 19, pp. 8364-8375, May 2016; X. Dong, J. Trembly, and D. Bayless, "Techno-economic analysis of hydraulic fracking flowback and produced water treatment in supercritical water reactor," *Energy*, vol. 133, pp. 777-783, August 2017; E. Cetinkaya, I. Dincer, and G. F. Naterer, "Life cycle assessment of various hydrogen production methods," 2010 *AIChE Annu. Meet. Top. Conf. Hydrog. Prod. Storage Spec. Issue*, vol. 37, no. 3, pp. 2071-2080, February 2012; and Y. Khojasteh Salkuyeh, B. A. Saville, and H. L. MacLean, "Techno-economic analysis and life cycle assessment of hydrogen production from natural gas using current and emerging technologies," *Int. J. Hydrog. Energy*, vol. 42, no. 30, pp. 18894-18909, July 2017]. $CO_2$ emissions associated with CO production are not readily reported; however, the $H_2$ and CO cogeneration molar ratio of 3:1 ($H_2$:CO) was used to estimate CO production emissions as 2.1-2.6 kg $CO_2$·kg-1 CO. Similarly, a recent lifecycle assessment of shale gas processing estimates $CO_2$ associated with $C_2H_6$ separation of 0.5 kg $CO_2$·kg-1 $C_2H_6$ separated [M. Yang, X. Tian, and F. You, "Manufacturing Ethylene from Wet Shale Gas and Biomass: Comparative Technoeconomic Analysis and Environmental Life Cycle Assessment," *Ind. Eng. Chem. Res*., vol. 57, no. 17, pp. 5980-5998, May 2018]. Lifecycle greenhouse gas reduction potential of the present inventor's process has been estimated utilizing selectivity information from preliminary e-ODH testing along with Aspen Plus simulation results. For this study, only $CO_2$ consumption/emissions associated with the proposed SOEC stack were taken into account. Further emissions may be possible from downstream oligomerization of $C^{2+}$ alkene intermediates. A summary of daily energy and $CO_2$ balances for the proposed process along with greenhouse gas emissions estimations for the products are provided in Table 7. To maximize carbon reduction potential, renewable power sources (wind or solar) were assumed as the source for electrical power. $CO_2$ emissions associated with CO and $C_2H_6$ separation for the process were 0.22 kg $CO_2$·kg-1 CO and 0.11 kg $CO_2$·kg-1 $C_2H_6$, indicating significant potential for the proposed process to reduce $CO_2$ emissions associated with these two important industrial sectors.

TABLE 7

| Preliminary Lifecycle Greenhouse Gas Estimates | | |
|---|---|---|
| Energy Balance | CO2 Reduction | 643 MWh |
| | Joule Gas Heating | 288 MWh |
| | Thermal Losses | 93.1 MWh |
| CO2 Emissions | CO2 Consumed | 457,591 kg |
| | CO2 Generated from e-ODH | 66,423kg |
| | CO2 Emitted from Electricity Generation | 0 |
| | Net CO2 Emitted | -391,159 kg |
| Product Emissions | CO | 0.22 kg CO2/kg CO |
| Greenhouse Gas | Ethane Separation | 0.11 kg CO2/kg C2H6 |

TABLE 7-continued

Example 4

The U.S. DOE-NETL's Carbon Use and Reuse program portfolio contains several projects focusing on ambient and high temperature $CO_2$ conversion pathways. Ambient temperature $CO_2$ conversion pathways include biotic (algae) and abiotic (catalytic) methods, which have potential to yield valuable end products. Water and nutrient management around algae-based systems can prove difficult to manage, while precious metal-based catalysts and aqueous oxygenate product slate (methanol, formic acid, etc.) are costly to separate yielding high capital/operating costs. High temperature pathways are a promising method for converting $CO_2$ into valuable materials, as the elevated temperature relaxes bonding between C and O allowing for easier conversion. Table 8 provides a summary of high temperature $CO_2$ conversion technology features associated with current or recently completed projects supported the U.S. DOE. In addition, HT recently began offering the eCOs™ on demand CO process, which utilizes SOEC technology based upon electrochemical $CO_2$ reduction ($CO_2 \rightarrow CO+0.5O2$). HT reports electrical power demand of 170-227 MWh per 1 MMscf CO produced [P. Kim-Lohsoontorn and J. Bae, "Electrochemical performance of solid oxide electrolysis cell electrodes under high-temperature coelectrolysis of steam and carbon dioxide," *Proc.* 2010 *Eur. Solid Oxide Fuel Cell Forum*, vol. 196, no. 17, pp. 7161-7168, September 2011]. DE-FE0029570 and DE-FE0030678 are both challenged by their requirement of pure hydrocarbon reactant feedstock, increasing operating costs, and competition with existing processes yielding the same products ($C_2H_4$ and $C_2H_4O$). DE-FE0004329 requires an upfront ASU to reduce CO product separation complexity. Conversely, DE-EE0005766 and HT's eCOs™ generate only a single valuable CO product stream from the electrochemical reduction of $CO_2$.

TABLE 8

| Current/Recent High Temperature CO2 Conversion Projects | |
|---|---|
| Project | Technology Features |
| Conversion of Waste CO2 and Shale Gas to High Value Chemicals [DE-EE0005766] | High-temperature SOEC (~875° C.) to convert $CO_2$ to CO.<br>Uses Ni-GDC cathode to reduce nearly pure $CO_2$ stream.<br>Generates single value-added CO product stream.<br>Combusts $CH_4$ to $CO_2/H_2O$ at anode to partially supplant $CO_2$ reduction endothermicity. |
| Low Temperature Process Utilizing Nano-Engineered Catalyst for Olefin Production from Coal Derived Flue Gas [DE-FE0029570] | Utilizes heterogeneous fixed-bed ODH catalyst to convert $C_2H_6$ to $C_2H_4$ using $CO_2$ as oxygen source.<br>Operates from 450-650° C. at 1 atm.<br>Requires pure $C_2H_6$ feedstock.<br>Generates complex product mixture requiring significant separation train to generate $C_2H_4$. |
| Novel Catalysts Process Technology for Utilization of CO2 for Ethylene Oxide and Propylene Oxide [DE-FE0030678] | Utilizes fluidizable oxygen carrier to extract oxygen from $CO_2$ and oxidize $C_2H_4$ to $C_2H_4O$.<br>Produces separate $CO_2$/CO and $C_2H_4/C_2H_4O$ streams.<br>Requires pure ethylene feedstock. |
| Conversion of CO2 into Commercial Materials Using Carbon Feedstocks [DE-FE0004329] | Utilizes transport reactor with fossil/biomass based-char and $O_2$ to reduce $CO_2$ to CO via reverse Boudarad reaction.<br>Operates at 800-900° C. at 1 atm.<br>Requires upfront air separation unit (ASU) to generate $O_2$. |

The present inventor's process is both distinctive and a logical progression from these previous efforts as the process: (1) Cogenerates CO and chemicals/fuels as valuable products, reducing process market sensitivity associated with a single product stream; (2) Offers greater thermal integration through use of the e-ODH reaction over existing $CO_2$ SOEC offerings; (3) Utilizes $C_2H_6$ contained in WNG, removing the need for upfront $C_2H_6$ or olefin separation; and (4) Easily separated CO (amine scrubbing) and alkene (oligomerization) products.

These innovations are possible by operating the SOEC process at intermediate temperature (650-750° C.), which allows for the selective conversion of $C_2H_6$ in the more stable $CH_4$ matrix. To enable operation of this process, high performance $CO_2$ reduction cathode and e-ODH anode using transition metal-metal oxide-based catalysts respectively, which operate at intermediate temperatures, are developed. Research planned to progress the proposed technology beyond previous studies is discussed in Example 5 (below).

The proposed scope of work includes laboratory testing to develop electrodes for cost effective conversion of $CO_2$ and $C_2H_6$ contained in WNG into valuable products and process simulation/modeling to estimate overall process costs and ability to integrate directly with coal-fired power plant flue gas. Details regarding the planned tests including material matrices, variables/levels, trial lengths, analytical methods, and gas compositions to be used may be found in the part "A" description of Example 5. The plan for evaluating effectiveness of the proposed technology may be found in the part "B" description of Example 5.

Example 5

The overall objective of this project is to develop a process which simultaneously converts $CO_2$ and NGLs (mainly $C_2H_6$) in wet natural gas (WNG) into valuable CO and chemicals/fuels respectively, using electrical energy. The primary objective of Phase I is to identify an intermediate temperature solid oxide electrolyzer cell (SOEC) process configuration that offers the technical feasibility of producing CO and removing $C_2H_6$ from WNG at costs equivalent to current commercial processes, with significant reduction in lifecycle $CO_2$ emissions over conventional processes. A secondary objective will be to evaluate the potential integration of the proposed process into a coal-fired power plant facility for direct utilization of $CO_2$ containing flue gas to match current commercial CO production and NGL separation costs.

The proposed project efforts focus on evaluating the technical feasibility of utilizing an intermediate temperature SOEC process to simultaneously convert $CO_2$ and $C_2H_6$ in WNG into CO and chemicals/fuels, respectively. These efforts include both experimental and process modeling/simulation components. The experimental effort seeks to develop high performance $CO_2$ reduction cathode and e-ODH anode using button cell laboratory tests yielding SOEC designs with feasible costs. The process modeling/simulation effort will evaluate proposed process economics associated with CO production and NGL separation costs utilizing captured $CO_2$ and flue gas streams. Furthermore, process simulations will be used to assess lifecycle $CO_2$ emissions associated with the proposed process.

A. Intermediate Temperature Solid Oxide Electrolysis Cell Development

Here, the present inventor will focus on developing intermediate temperature (650-750° C.) $CO_2$ reduction and NGL oxidation electrodes using transition metals (Co and Ni) as the reduction catalysts and lanthanum strontium iron-La1-xSrxO3-δ (LSF) perovskites as the oxidation catalysts. Laboratory button cell tests will be completed in the present inventor's existing SOFC R&D laboratory. To ensure quality/repeatability of the experimental efforts, commercial scandia doped zirconia-based electrolyte membranes (ScSZ—supplied by Nexceris) will be used for all experimental trials. In this effort, the present inventor will utilize gadolinium doped ceria [Gd0.10Ce0.9001.95 (GDC)—supplied by Nexceris] as the porous triple phase boundary scaffold with subsequent catalyst infiltration for both the cathode and anode. To allow for rapid material development/screening, both the $CO_2$ and NGL electrode development tests will initially focus on their corresponding reduction and oxidation chemistry (as shown in Equations 18 to 21) while the counter reaction will be a performed by the same electrode system (consisting of (La0.80Sr0.20)0.95MnO3-X (LSM) and LSM-GDC interlayer). The best cathode and anode catalyst materials and electrode structure with optimized synthesis techniques and operating conditions will be used in the final combined electrocatalyst screening tests.

| | |
|---|---|
| $CO_2$ Reduction Cathode: $CO_2 + 2e- \rightarrow CO+O_2-$ | Eq. 18 |
| $CO_2$ Reduction Anode: $2O^2- \rightarrow O_2 + 4e-$ | Eq. 19 |
| NGL Oxidation Cathode: $1/2O_2 + 2e- \rightarrow O^2-$ | Eq. 20 |
| NGL Oxidation Anode: $C_2H_6 + O^2- \rightarrow C_2H_4 + H_2O+2e-$ | Eq. 21 |

1. $CO_2$ Reduction Cathode Development

Catalyst Synthesis—Infiltration and Reduction Analysis: Porous GDC scaffold will be prepared by screen printing GDC ink containing pore former (90 wt. % GDC & 10 wt. % graphite in α-terpeniol) onto commercial ScSZ membranes (0:2.5 cm, ~150 μm thick). The screen-printed electrolyte sintered at 1350° C. produces a well adhered porous GDC layer (due to pore former decomposition) with sufficient porosity to allow maximum penetration of catalyst infiltration solution. Then, the $CO_2$ reduction catalyst (Co—Ni) precursor solution will be infiltrated into the porous GDC scaffold using a microsyringe to produce the catalyst infiltrated GDC electrode. The 1 M Co—Ni precursor solution (total moles of metal ions) will be prepared using $Co(NO_3)_2.6H_2O$ and $Ni(NO_3)_2.6H_2O$ dissolved in deionized water with appropriate amounts of citric acid and surfactant. Several Co—Ni alloy (with Co content ranging from 0-100 wt. %, in 20 wt. % increments) precursor solutions will be prepared and infiltrated on the GDC scaffold. The addition of citric acid to Co—Ni precursor solutions (1:0.33-1.0, moles metal ions: moles citric acid) to aid alloy formation and surfactant (Triton™, sodium dodecylbenzenesulfonate, and sodium dodecyl sulfate) to improve metal precursor penetration will also be studied.

Figure 13:
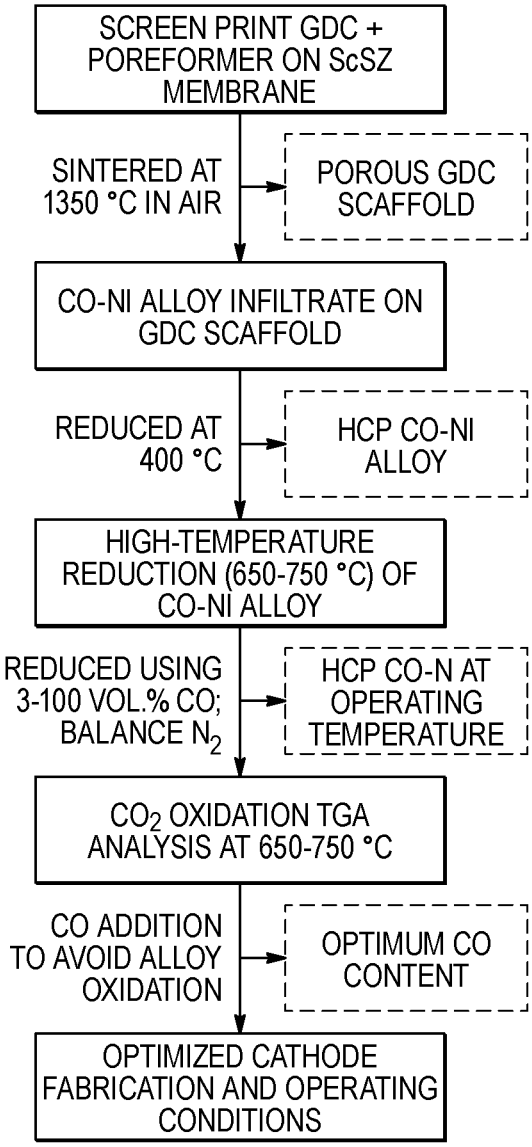
FIG. 13 is a flow chart showing cathode infiltration/reduction methodology.

One innovation to be evaluated in this study is the ability to stabilize Co-containing HCP structures, which have theoretically been shown to be more active for electrochemical $CO_2$ reduction (Methodology used to achieve the desired HCP Ni—Co alloy catalyst for $CO_2$ reduction cathode is shown in FIG. 13). The infiltrated GDC electrode with the alloy precursor nitrates will be allowed to decompose under a reducing environment (CO, $H_2$/CO, and $H_2$) to form the desired HCP structure Ni—Co alloy at 400° C. and prevent bulk metal oxide formation. A brief treatment in dilute 02 may be needed to form a thin oxide scale to avoid any pyrophoric reaction. The electrode is then weighed and the infiltration/drying process repeated until the desired catalyst metal content is achieved. X-ray diffraction (XRD, PanAnalytical X'pert Pro) will be used to identify phase formation of the alloy infiltrate after calcination. Scanning electron microscopy with energy-dispersive X-ray spectrometer attachment (SEM JEOL JSM-6390/Quantax 400 w. Xflash 6) will be used to explore the electrode active layer microstructure prior to and after alloy infiltration to evaluate infiltrate coverage and penetration. The impact of final sintering reduction temperature (650-750° C.) and reducing gas composition (3-100 vol. % CO, balance $N_2$) on the Co-based alloy will be investigated to determine the operating conditions for electrocatalyst screening tests. Samples will be sintered at the final temperature for 1-3 hr and cooled to room temperature while maintaining the reducing gas environment and later analyzed using SEM and XRD to identify catalyst morphology and crystal structure, respectively. To expedite these analyses, several infiltrated GDC pellets will be tested simultaneously in an atmosphere-controlled quartz tube placed in a temperature-controlled furnace. High temperature reduction conditions which establish HCP-Co structure will be selected for further screening tests described below.

Catalyst Oxidation Analyses: Pure $CO_2$ is known to cause oxidation of Co and Ni at intermediate operating temperatures, thermal gravimetric analysis (TGA) will be performed to determine the CO content necessary to prevent oxidation of Co—Ni alloys. Co—Ni alloyed GDC electrode with HCP structure obtained from the synthesis and reduction step will be ground to powder and tested via TGA. Carbon deposition rates will be established from 650-750° C., followed by identification of the inlet gas CO content (vol. %) necessary to prevent carbon deposition over the operating temperature range. The inlet gas CO content determined to prevent carbon deposition will then be used in the electrochemical experiments described below.

Figure 14:
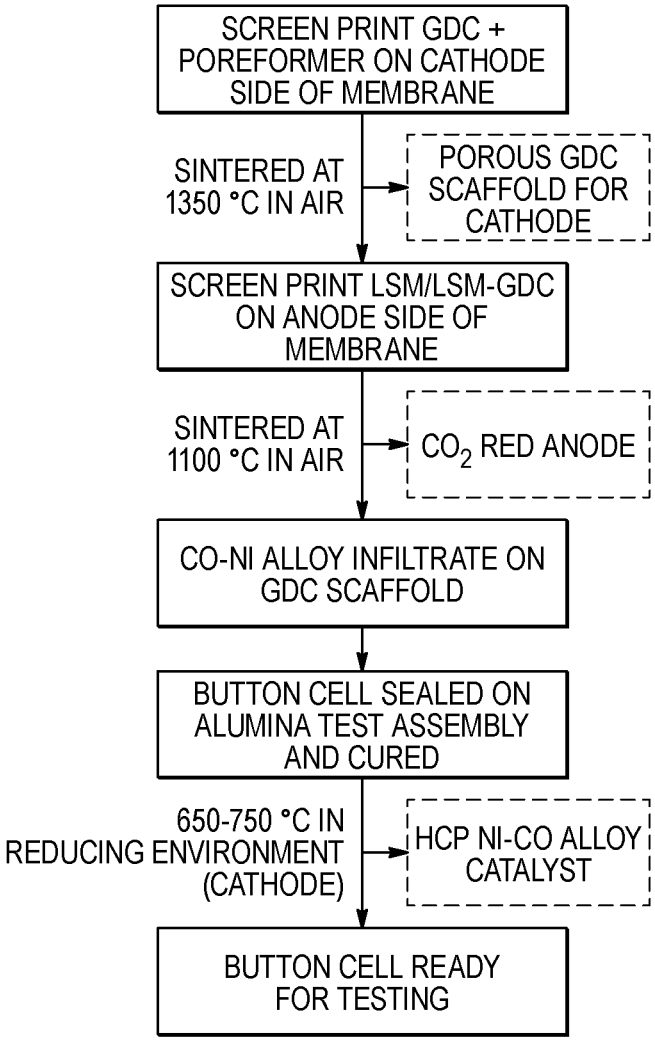
FIG. 14 is a flow chart showing co-based electrocatalyst testing.

$CO_2$ Reduction Cathode Cell Preparation, Assembly, and Testing: The $CO_2$ reduction electrode development cell configuration will be as follows Co—Ni/GDC|ScSZ|LSM-GDC|LSM and will be prepared as shown in FIG. 14. The porous GDC cathode scaffold will be prepared by screen printing the GDC ink containing pore formers on the ScSz membrane and sintered at 1350° C. in air. Then, an Au ring electrode (reference) will be screen printed around the GDC layer to allow cathode overpotential to be determined during testing. Next, commercial LSM-GDC and LSM inks will be screen printed and sintered at 1100° C. in air to form the $CO_2$ reduction anode electrode for $O^{2-}$ recombination. Finally, the Co—Ni alloy infiltrate with optimized synthesis conditions will be infiltrated on the GDC scaffold. Current collectors and potential probes for the working, counter, and reference electrodes will be added to the $CO_2$ reduction anode button cell. The button cell assembly will be sealed (using glass seal) to an existing alumina test assembly designed to minimize gas residence time for rapid establishment of steady state product composition.

Co-based Electrocatalyst Screening Tests: The $CO_2$ reduction anode button cell assembly will be placed into a temperature-controlled furnace and the performance of Co-containing electrocatalysts will be determined using a $CO_2/C_0$ atmosphere at the cathode and air at the anode. Mass flow controllers (MFCs) will be used to control both the cathode and anode gas flows. Initial electrocatalyst screening trials will be conducted at low fuel utilizations (<5%) to prevent mass transfer impacts. The cells will be operated in $CO_2$ electrolysis mode using galvanostatic conditions. Electrocatalyst performance (HCP Co—Ni alloys) with loading (10, 25, 50 wt. %), operating temperature (650, 700, and 750° C.), and current density (0-1.0 A·cm-2; 0.2 A·cm$^{-2}$ increments) will be determined. A Gamry 5000E Potentiostat/Galvanostat/ZRA will be used to conduct galvanostatic and electrochemical impedance spectroscopy (EIS) tests. Current interrupt testing (CIT) will be used in conjunction with the reference electrode to determine $CO_2$ reduction electrokinetics. An Inficon micro-GC will be used to analyze cathode product composition. Additional Co—Ni compositions may be evaluated based upon screening results. Results from the trials will be used for down-selection of Co—Ni catalyst composition to determine electrochemical performance in flue gas atmosphere and long-term performance in $CO_2$.

Flue Gas and Long-term Electrocatalyst Performance Testing: Another innovation of the process is its ability to potentially utilize flue gas as a $CO_2$ source, thereby, decreasing power plant carbon capture costs. Further, the proposed stack design could potentially offer the ability to first utilize $O_2$ contained in flue gas as an oxygen source (instead of air) for the second cell, making the flue gas adaptable for electrochemical $CO_2$ reduction with reduced $O_2$ partial pressure. An understanding of flue gas components ($N_2$, $O_2$, NOx, SOx) on electrocatalyst performance will be developed to determine necessary upfront flue gas conditioning. In these trials, the impact of flue gas components on the down-selection of Co-based electrocatalyst composition(s) will be determined. The wet and dry flue gas component ranges to be investigated are shown in Table 9. Further long-term performance (500 hr) of the down-selected Co-based electrocatalyst composition(s) will be determined for the $CO_2/C_0$ composition used in electrocatalyst screening tests. The possible impact of flue gas components on commercial LSM/LSM-GDC cathodes will also be investigated. Data generated from these tests will be used in part "B" of this Example 5 to develop stack design/power requirements and process configuration(s) which directly utilizes flue gas from coal-fired power plant.

TABLE 9

Electrochemical $CO_2$ Reduction Flue Gas Testing Composition Range.

| Component | Composition Range |
|---|---|
| $CO_2$ | 10-12 vol. % (wet); 12.5-14.5 vol. % (dry) |
| $H_2O$ | 0-23 vol. % |
| $O_2$ | 2-5 vol. % (wet); 5-7 vol. % (dry) |
| $NO_x$ | 150-250 ppmv (wet); 230-410 ppmv (dry) |
| $SO_x$ | 10-200 ppmv (wet); 12-250 ppmv (dry) |
| $N_2$ | Balance |

Figure 15:
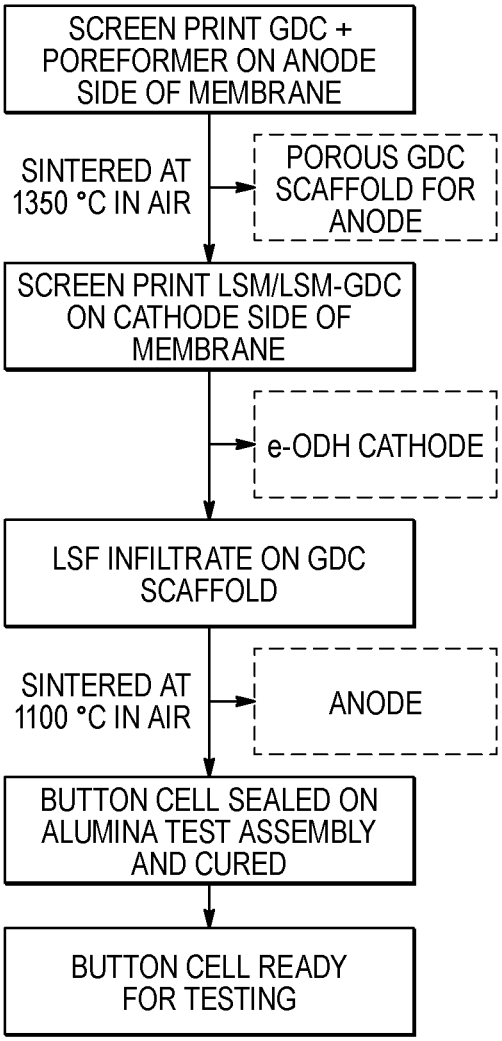
FIG. 15 is a flow chart showing cathode infiltration/reduction methodology.

2. e-ODH Anode Development e-ODH Cell Fabrication: In this subtask, the present inventor will develop an e-ODH anode for selective conversion of $C_2H_6$ to alkene in a natural gas matrix. The e-ODH anode button cell design and fabrication will be similar to the one described above. The ScSZ membrane e-ODH anode button cell will consist of a porous GDC scaffold with LSF infiltrate catalyst as anode and an Au ring electrode as the reference electrode, while LSM/LSM-GDC will act as the e-ODH cathode. The e-ODH anode development cell configuration will be as follows LSF-GDC|ScSZ|LSM-GDC|LSM and will be prepared as shown in FIG. 15. The LSF precursor solution will be prepared using $La(NO_3)_3 \cdot 6H_2O$, $Fe(NO_3)_3 \cdot 9H_2O$, and $Sr(NO_3)_2$ dissolved deionized water with optimized amounts of citric acid and surfactants and NaOH to achieve a pH of 5 to achieve single phase LSF perovskite. The infiltrated GDC scaffold will be dried at 300° C., weighed, and the infiltration/drying steps will be repeated to achieve desired loadings ranging between 20-40 wt. % LSF. The surface morphology and crystal structure of the LSF infiltrated GDC electrode will be characterized using XRD and SEM and the e-ODH button cell will be assembled as explained in subpart "1" to part "A" of this Example 5.

e-ODH Electrocatalyst Screening Tests: The button cell assembly will be placed into a temperature-controlled furnace and performance of LSF electrocatalysts will be determined using WNG atmosphere at the anode and air at the cathode. Both the anode and cathode flowrates will be controlled using MFCs. Initial electrocatalyst screening trials will be conducted at low fuel utilizations (<5%) to circumvent mass transfer limitations and the anode gas composition range to be investigated is shown in Table 10. Electrocatalyst performance ($La_xSr_{1-x}FeO_3$; x=0-1 in 0.2 increments) with loading (25 and 50 wt. %), operating temperature (650, 700, and 750° C., and current density (0-1.0 $A \cdot cm^{-2}$; 0.2 $A \cdot cm^{-2}$ increments) will be determined. The electrochemical and gas output analysis for the e-ODH anode button cells will be evaluated similar to $CO_2$ reduction cathode button cells as explained in subpart "1" to part "A" of this Example 5. Halide incorporation in perovskites have shown to significantly improve alkene selectivity. Therefore, the LSF catalysts identified with best performance will be evaluated with halide addition for alkene selectivity and long-term performance tests (500 hr) will also be performed for all high-performance catalysts.

TABLE 10

Electrochemical e-ODH WNG Testing Composition Range.

| Component | Composition Range |
|---|---|
| $CH_4$ | 76-89 vol. % |
| $C_2H_6$ | 10-20 vol. % |
| $C_3H_8$ | 0-3 vol. % |
| $N_2$ | 1.0 vol. % |

Combined $CO_2$ Cathode and e-ODH Anode Assembly and Testing: The best performing $CO_2$ reduction and e-ODH oxidation electrocatalysts will be used to assemble the combined $CO_2$ cathode and e-ODH anode button cell. The porous GDC scaffold is first produced on both sides of the ScSz membrane and sintered at 1350° C. in air followed by the infiltration of e-ODH catalyst (LSF) on the anode side and subsequent sintering at 1100° C. in air. Finally, the $CO_2$ reduction catalyst (Ni—Co alloy) is infiltrated on the cathode side. The combined catalyst button cell is assembled with a cell configuration of Co—Ni-GDC|ScSZ|LSF-GDC and sintered in reducing environment at cathode to complete the HCP Ni—Co alloy formation and tested similar to $CO_2$ cathode and e-ODH anode button cells. Data generated from this subtask will be used in part "B" of this Example 5 to evaluate stack design/power requirements and necessary processing for down-stream alkene conversion.

B. Process Simulation/Modeling and Techno-Economic Studies

Here, Aspen Plus simulation package will be used to investigate the process configuration required in the proposed process where electrical power is used to simultaneously convert $CO_2$ into CO and selectively remove $C_2H_6$ from WNG. Some goals for evaluating process configurations will be to maximize $CO_2$ conversion, minimize electrical power consumption, and optimize heat integration. the present inventor will modify previously reported electrochemical models for solid oxide fuel cells to design and evaluate the operation of the dual cell configuration. As the experimental data from part "A" of this Example 5 becomes available, the Aspen models will be modified as necessary to more accurately reflect the experimental data. Process economics for several configurations will be evaluated to establish the net cost of the CO and chemical/fuel products and to identify key factors that can be used to further reduce cost. Integration of the proposed process to directly utilize flue gas as the $CO_2$ source will be studied along with the impact on product costs. In addition, $CO_2$ emissions lifecycle analyses will be performed to assess $CO_2$ emissions for the proposed process in comparison to existing conventional CO production and ethane separation technologies. DOE/NETL quality guidelines for energy system studies will be used to ensure that the results from this effort are consistent with similar studies being sponsored by DOE/NETL. The process economics will be used to define the optimal process configuration for the proposed $CO_2$ conversion process.

Example 6

The present inventor has been developing e-ODH electrocatalysts for the selective conversion of $C_2H_6$ to $C_2H_4$ in a natural gas matrix. A thorough literature review showed lanthanum strontium iron-La1-xSrxO3-δ (LSF) perovskites possess promising stability and high $C_2H_4$ selectivity in a reducing environment. FIG. 10 shows XRD data for several LSF catalysts synthesized by the present inventor and their associated oxygen deficiency (δ) determined using thermal gravimetric analysis. Comparing the XRD spectra with literature showed the present inventor's synthesis method is able to successfully produce single phase perovskites and the catalyst materials possess oxygen vacancies necessary for conducting oxide ions ($O^{2-}$) for reaction with $C_2H_6$.

LSF0.9 (with the greatest oxygen vacancy) was selected for the present inventor's initial e-ODH tests. The first button cells for electrochemical tests were made with an LSM/LSM-GDC cathode, commercial ScSZ membrane, and pure LSF0.9 catalyst screen printed anode. Initial results with this anode were poor, likely due to an insufficient triple phase boundary at the anode/membrane interface. To improve performance, the LSF0.9 catalyst was mixed with GDC (50/50 mass ratio) and screen printed on the same membrane/cathode combination. FIG. 11A presents an SEM/EDS cross-sectional analysis of the present inventor's LSF0.9/GDC anode, along with measured total electrical conductivity data for select LSF catalysts. The cross-section image shows good mixing between LSF0.9 and GDC with sufficient adherence to the electrolyte. Target total electrical conductivities for SOFC anodes reported in literature is 100 S/cm with the lowest limit being 1 S/cm [J. W. Fergus, Solid State Ion., vol. 177, no. 17, pp. 1529-1541, July 2006]. Conductivity tests for synthesized LSF indicate the materials should possess sufficient conductivity for the e-ODH application.

A button cell was mounted to a specially designed alumina test fixture which minimized gas residence time, thereby minimizing thermal cracking of $C_2H_6$ allowing for e-ODH performance to be determined. e-ODH results with the LSF0.9-GDC anode are shown in FIG. 12A. The results reported here have been corrected for the limited thermal cracking associated with the system. To achieve these current densities the cell was operated electrolytically applying up to 2 V as neither electrode is optimized. Preliminary results with LSF0.9 electrocatalyst show promising $C_2H_4$ selectivity of nearly 80%, compared to thermal cracking conversion and selectivity of 2% and 57.5%, respectively. A major innovation proposed by the present inventor is to selectively complete e-ODH of $C_2H_6$ in WNG with limited $CH_4$ conversion. By operating the e-ODH cell at intermediate temperature (650-750° C.), selective $C_2H_6$ conversion in a $CH_4$ matrix is feasible due to $C_2H_6$'s significantly higher activity at these temperatures in comparison to $CH_4$ [M. Younessi-Sinaki, E. A. Matida, and F. Hamdullahpur, Int. J. Hydrog. Energy, vol. 34, no. 9, pp. 3710-3716, May 2009; Y. Hidaka, K. Sato, Y. Henmi, H. Tanaka, and K. Inami, Combust. Flame, vol. 118, no. 3, pp. 340-358, August 1999; and Y. Hidaka et al., Combust. Flame, vol. 120, no. 3, pp.

245-264, February 2000]. The purpose of this project is to develop an e-ODH anode to have high $C_2H_6$ activity at intermediate temperature with $C_2H_6$ selectivity >90% and low overpotential. These goals are feasible based upon the encouraging preliminary experimental results already obtained by the present inventor. Further conversion of alkenes to chemicals/fuels is an efficient and well documented process with technology packages offered by several catalyst manufacturers [A. Hwang et al., Catal. Lett., vol. 147, no. 6, pp. 1303-1314, June 2017; R. D. Andrei, M. I. Popa, F. Fajula, and V. Hulea, J. Catal., vol. 323, pp. 76-84, March 2015; B. H. Babu, M. Lee, D. W. Hwang, Y. Kim, and H.-J. Chae, Appl. Catal. Gen., vol. 530, pp. 48-55, January 2017; S. Moon, H.-J. Chae, and M. B. Park, Appl. Catal. Gen., vol. 553, pp. 15-23, 2018; S. Lin et al., Microporous Mesoporous Mater., vol. 184, pp. 151-161, January 2014; and S. Moussa, M. A. Arribas, P. Concepcion, and A. Martinez, Sel. Pap. 6th Czech-ltal.-Span. Conf. Mol. Sieves Catal. Amantea Italy June 14th 17th 2015, vol. 277, pp. 78-88, November 2016].

A. Anticipated Public Benefits

The largest anticipated benefit for this novel process technology for upgrading well-head natural gas is full realization of the economic value of both the NGLs and methane portions of well-head natural gas. Currently, over supply, especially of ethane; insufficient infrastructure linking the NGL sources to potential consumers; and energy intensive commercial upgrading technologies are forcing prime value hydrocarbons like ethane to be sold for fuel value or even worse, being flared as natural gas pipeline specifications are more rigorously enforced. This novel process technology offers the potential to cost-effectively upgrade well-head natural gas to pipeline-quality natural gas and convert the NGL portion of the well-head natural gas into high-value gasoline or other valuable fuels/chemicals.

The modular nature of this novel process is also ideally suited for distributed application making the well head the ideal location for installation, which only makes this technology more promising for optimizing full economic recovery for remotely distributed well-head gas. With smaller modular systems, the technology will benefit from a larger pool of financial funding sources lowering risk for these modular systems. With more potential financial resources available, more projects can be expected to move forward simultaneously stimulating more local value from these natural resources in job creation and economic growth/expansion.

TABLE 11

Technical Success Criteria

| Criteria | STTR Phase I | Ultimate |
|---|---|---|
| $S_{C2H4}$ | 81.9% | 73.9-89.9% |
| $S_{CO}$ | 10.3% | 5.7-14.9% |
| $S_{CO2}$ | 7.7% | 4.3-11.1% |
| $Y_{C2H4}$ | 0.435 | 0.25-0.62 |
| $\eta_{anode}$ | 0.900 V | 0.794 V |

B. Technical Objectives

The proposed work plan for this STTR Phase I project was developed based the following three technical objectives: (1) Experimentally demonstrate the e-ODH process has the prospective of meeting the necessary operating specifications shown in Table 11 (See part C.1. of this Example 6, below); (2) Experimentally assess coking potential of the e-ODH process and if necessary, identify steam-to-carbon ratio to prevent coking (See part C.2. of this Example 6, below); and (3) Optimize integration of oligomerization process within overall process scheme for performance requirements through process simulation and techno-economic studies (See part D. of this Example 6, below).

These technical objectives were developed to address research needs for the e-ODH process as discussed in the following analysis.

Figure 16:
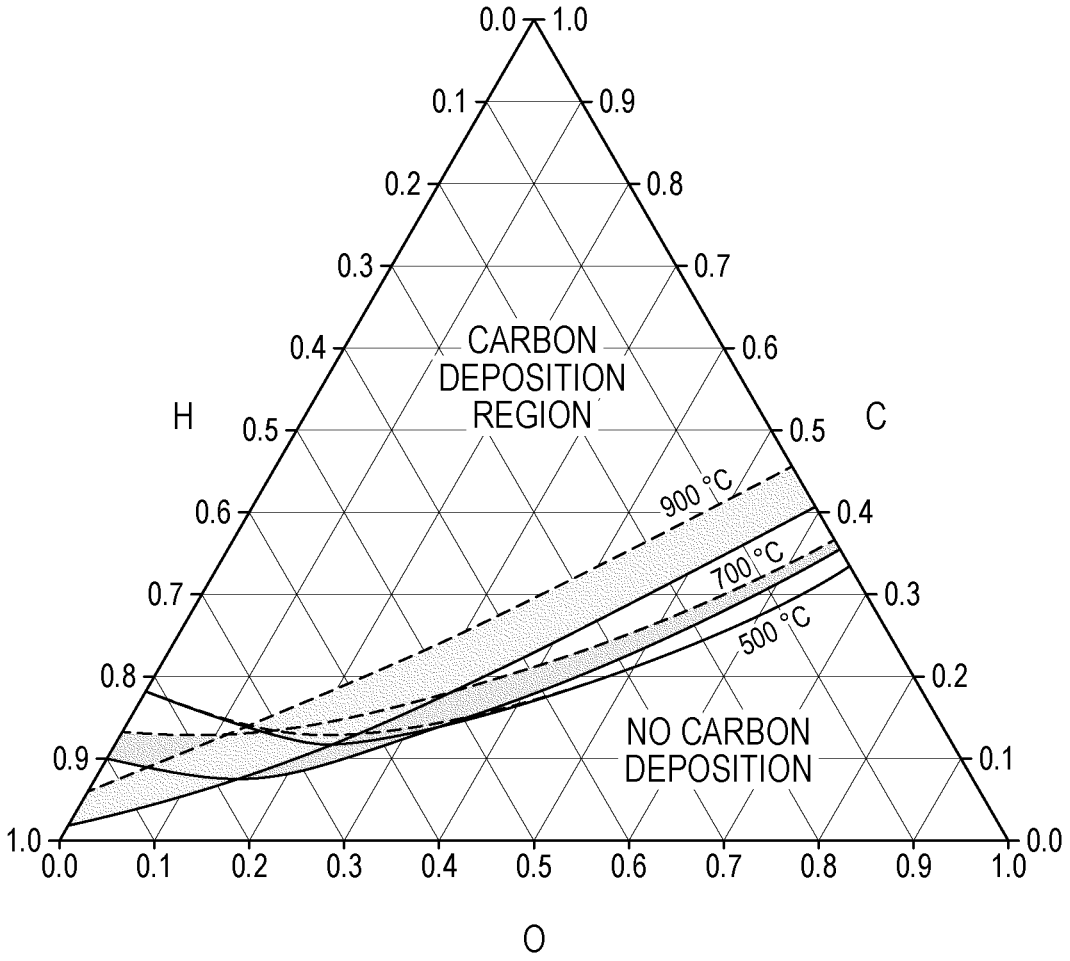
FIG. 16 is a C—H—O ternary diagram with carbon deposition regions.

Based upon the analyses described above, Table 11 presents e-ODH performance targets for Phase I and ultimate efforts. The selectivity, conversion and process power requirements have been selected as each are necessary in order for the proposed e-ODH process to be an attractive alternative to turbo-expansion NGL separation. FIG. 16 shows a C—H—O ternary diagram with carbon and non-carbon deposition regions plotted for temperatures ranging from 500-900° C. along with the C—H—O composition for $CH_4$, $C_2H_6$, and $C_3H_8$. As can be seen well-head natural gas at the operating temperatures for the proposed e-ODH process poses a coking risk, which the present inventor will experimentally evaluate and reduce as much as possible. Further, the conversion of alkenes generated from the e-ODH electrochemical cell into value-added fuels and chemicals will have a significant impact on the overall process performance and economics. With process simulations, the present inventor will identify optimal selectivity, yields, and lifetime requirements for oligomerization catalysts, and optimal integration schemes. All experimental e-ODH and electrocatalyst coking results will also be included in process simulations to further refine estimates of process performance and economics.

Figure 17:
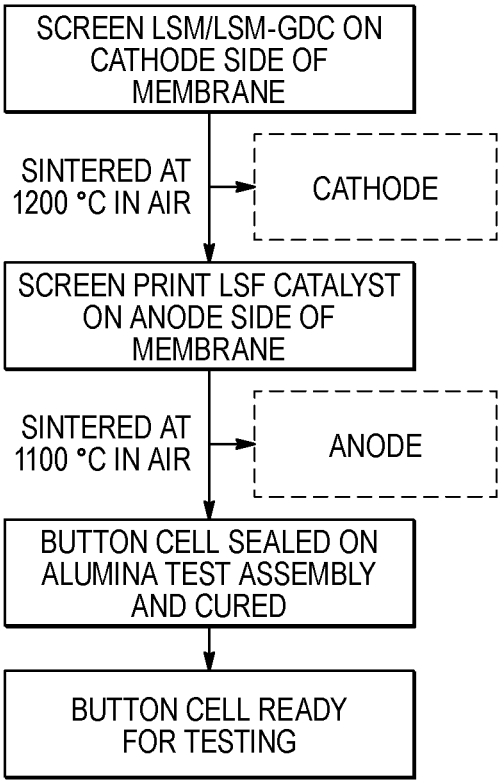
FIG. 17 is a flow chart showing anode infiltration/testing methodology.

C. e-ODH Electrochemical Cell Testing 1. e-ODH Cell Fabrication: Here, the present inventor will develop an e-ODH anode for selective conversion of $C_2H_6$ to $C_2H_4$ in a natural gas matrix. The ScSZ membrane e-ODH anode button cell will consist of a porous GDC scaffold with LSF catalyst as anode and an Au ring electrode as the reference electrode, while LSM/LSM-GDC will act as the e-ODH cathode. The e-ODH anode development cell configuration will be as follows LSF-GDC|ScSZ|LSM-GDC|LSM and will be prepared as shown in FIG. 17. The LSF precursor solution will be prepared using $La(NO_3)_3 \cdot 6H_2O$, $Fe(NO_3)_3 \cdot 9H_2O$, and $Sr(NO_3)_2$ dissolved in deionized water with optimized amounts of citric acid and surfactants and NaOH to achieve a pH of 5 to achieve single phase LSF perovskite. The infiltrated GDC scaffold will be dried at 300° C., weighed, and the infiltration/drying steps will be repeated to achieve desired loadings ranging between 20-40 wt. % LSF. The surface morphology and crystal structure of the LSF infiltrated GDC electrode will be characterized using XRD and SEM. Current collectors and potential probes for the working, counter, and reference electrodes will be added to the button cell. The button cell assembly will be sealed (using glass seal) to an existing alumina test assembly designed to minimize gas residence time for rapid establishment of steady-state product composition.

2. Electrocatalyst Coking Assessment: Coking of the catalyst surface can be a particularly problematic issue when processing such well-head gas streams at higher temperatures (500-800° C.). Coke buildup at the anode/electrolyte interface (i.e. triple phase boundary) is unlikely, due to the high oxygen flux emanating from the electrolyte. However, this interface and the bulk of the electrode material may observe coking at open cell and operating conditions, respectively. In particular, coke build up on the catalyst surface could decrease catalytic activity and/or block flow of reactants/products to and from the anode/electrolyte interface. Although oxide-based catalysts, such as the LSF materials proposed in this study, are less susceptible to coking, this possibility must be investigated. Further, coking within the process and anode may be prevented by recycling anode exhaust containing product water from the e-ODH reaction (Eq. 9).

Here, the present inventor will assess coking potential of the LSF material series using thermogravimetric analyses (TGA). Coking on LSF catalyst samples will be assessed with ethane, methane, and simulated well-head gas mixtures from 500-800° C. Should coking be found to take place, the addition of steam to the gas mixture will be assessed to determine the C—H—O ratio necessary to prevent coking. Results from this subtask will be used in part C.3. and part D. of this Example 6 to determine the impact of moisture content on product selectivity/ethylene and define the level of anode exhaust recycle required to prevent coking.

3. e-ODH Electrocatalyst Screening Tests: The button cell assembly described in part C.2. of this Example 6, above, will be placed into a temperature-controlled furnace and performance of LSF electrocatalysts will be determined using ethane, methane, and WNG atmospheres at the anode and air at the cathode. The purpose of the various gases is to assess performance of the LSF electrocatalyst for converting ethane and propane in the presence of methane. Both the anode and cathode flowrates will be controlled using MFCs. Initial electrocatalyst screening trials will be conducted at low fuel utilizations (<5%) to circumvent mass transfer limitations. The anode gas composition range to be investigated is shown in Table 12. Electrocatalyst performance ($LaxSr1\text{-}xFeO_3$; x=0-1 in 0.2 increments) with loading (25 and 50 wt. %), operating temperature (650, 700, and 750° C., and current density (0-1.0 $A\cdot cm^{-2}$; 0.2 $A\cdot cm^{-2}$ increments) will be determined. The electrochemical and gas output analysis for the e-ODH anode button cells will be evaluated using electrochemical impedance spectroscopy (EIS) and galvanostatic testing using a Gamry 5000E Potentiostat/Galvanostat/ZRA. Current interrupt testing (CIT) will be used in conjunction with the reference electrode to determine e-ODH electrokinetics. An Inficon micro-GC will be used to analyze anode product composition to determine conversion and product selectivities. Halide incorporation in perovskites have shown to significantly improve alkene selectivity. Therefore, the LSF catalysts identified with best performance will be evaluated with halide addition for alkene selectivity. Further, the tests will assess the impact of coking on anode performance. Results from the button cell tests will be incorporated into the Aspen Plus simulation to reflect actual operating performance established through materials synthesis and experimental testing.

TABLE 12

Electrochemical e-ODH WNG Testing Composition Range.

| Component | Composition Range |
|---|---|
| $CH_4$ | 76-89 vol. % |
| $C_2H_6$ | 10-20 vol. % |
| $C_3H_8$ | 0-3 vol. % |
| $N_2$ | 1.0 vol. % |

D. Techno-Economic Study

In this task, Aspen Plus simulation package will be used to investigate the process configurations to meet ethane separation requirements and minimize process energetics. Some goals for evaluating process configurations will be to maximize ethane conversion, minimize electrical power consumption, and optimize heat integration. Previously reported electrochemical models for solid oxide fuel cells will be modified to design, evaluate, and integrate the e-ODH process onto a well pad. As the experimental data from part C of this Example 6 becomes available, the Aspen models will be modified as necessary to more accurately reflect the experimental data. Further, process performance requirements for the oligomerization portion of the process will be identified (product selectivity, catalyst lifetime, etc.) and used to identify commercial oligomerization catalysts best suited for the proposed process. Process economics for several configurations will be evaluated to establish the net cost of ethane separation and chemical/fuel products and to identify key factors that can be used to further reduce cost. DOE/NETL quality guidelines for energy system studies will be used to ensure the results from this effort are consistent with similar studies being sponsored by DOE/NETL. The process economics will be used to define the optimal process configuration for the proposed e-ODH process.

Example 7

The selective oxidation process consists of a solid oxide fuel cell or solid oxide electrolysis cell. The electrochemical cell may be used to convert alkane or alkenes into derivative alkenes or alkene oxides. Examples of anode fuels include methane, ethane, propane, butane, ethene, propene or mixtures thereof. Example products include ethene, propene, butene, ethylene oxide, etc. The anode of the electrochemical device is composed of a composite anode consisting of a scaffold material which provide ionic conductivity, ideally yttria stabilized zirconia, more ideally Scandia stabilized zirconia, or even more ideally gadolinia doped ceria. In addition, the composite electrode also consists of an electrocatalyst to promote the selective electrochemical oxidation of hydrocarbons. Ideally, this electrocatalyst is composed of a mixed oxide material in the form of single/double perovskite, pyrochlore, spinel, etc. In addition, promoter materials may be included in the composite electrode consisting of oxide, mixed oxide, or metallic or mixtures thereof to enhance performance.

Figure 18A:
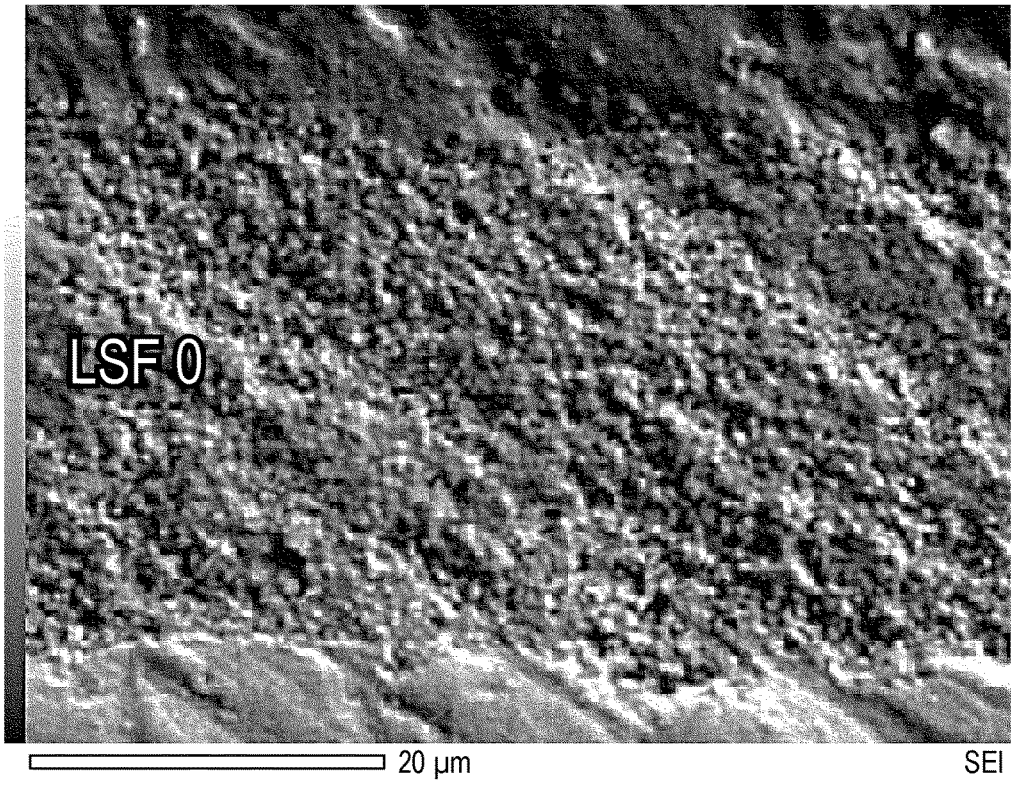
FIG. 18A is a microphotograph of LSF0.
Figure 18B:
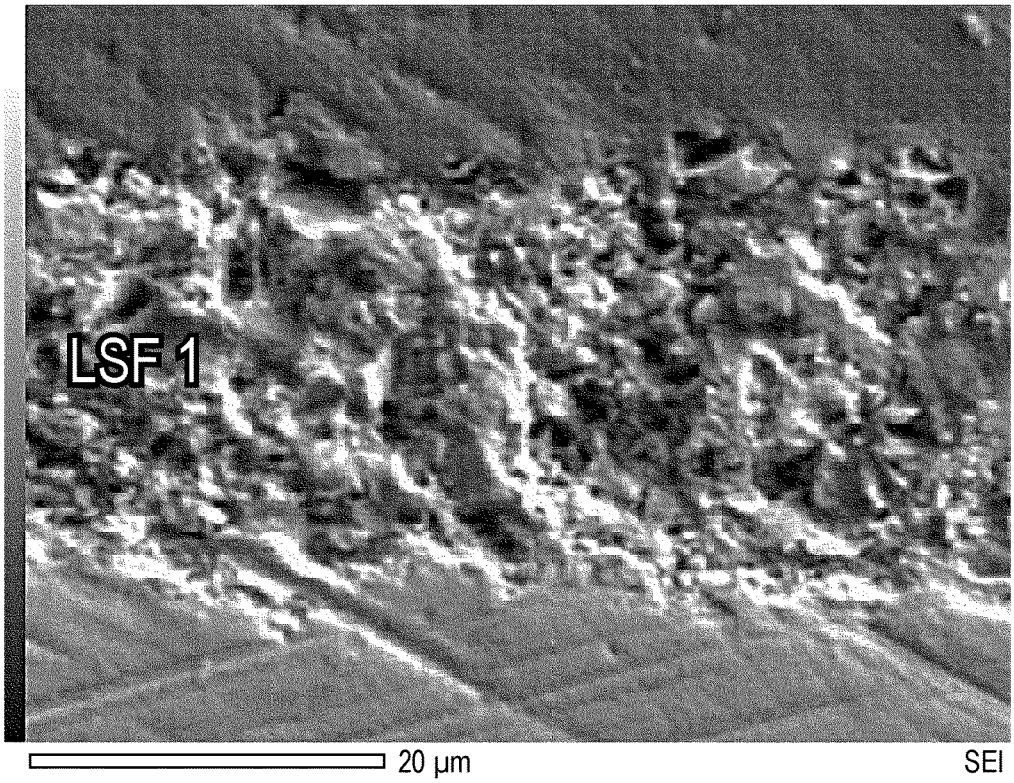
FIG. 18B is a microphotograph of LSF1.
Figure 19:
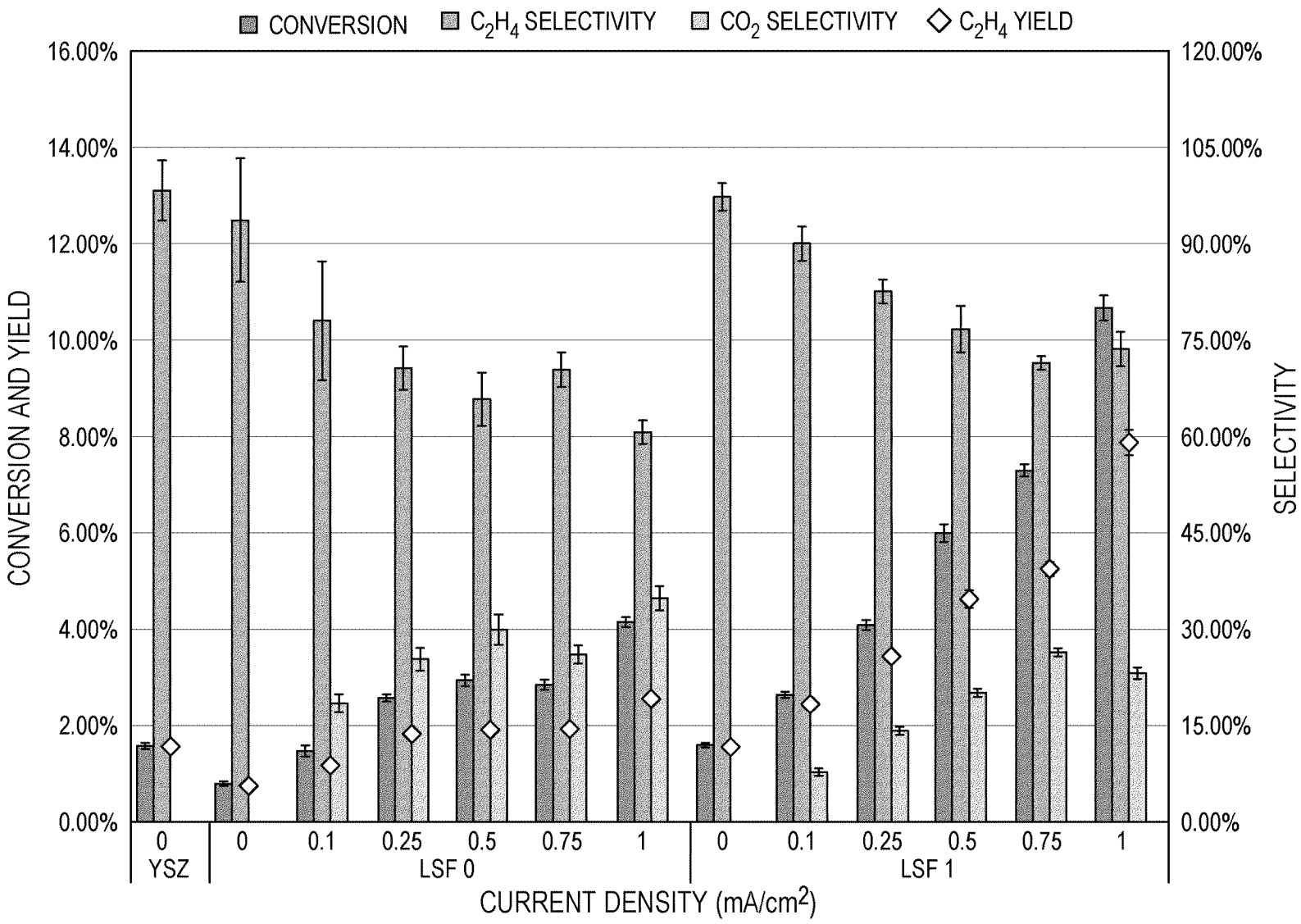
FIG. 19 is a graph of conversion $C_2H_4$ yield, and selectivity of $CO_2$ and $C_2H_4$ against current density for YSZ, LSF0, and LSF1.

In the embodiment shown in FIGS. 18A, 18B, and 19, a mixed oxide electrocatalyst with the formulation $La_{1-x}Sr_xFeO_3$ is shown, with x representing the amount of Sr in the material. Results demonstrate the electrochemical promotion of selective oxidation of ethane to ethene, in this case.

While the present invention has been disclosed by reference to the details of preferred embodiments of the invention, it is to be understood that the disclosure is intended as an illustrative rather than in a limiting sense, as it is contemplated that modifications will readily occur to those skilled in the art, within the spirit of the invention and the scope of the amended claims.

What is claimed is:

1. A method for converting carbon dioxide and natural gas liquids into carbon monoxide and other chemicals and/or fuels, comprising:

electrochemically converting $CO_2$ into CO with an electrocatalyst and converting $C_2H_6$ from the natural gas liquids into $C_2H_4$ with the electrocatalyst at a temperature in the range of 650° C.-750° C., wherein the electrocatalyst is selected from a group consisting of a perovskite, a pyrochlore, and a spinel.

2. The method of claim 1, wherein converting the $CO_2$ into the CO and converting the $C_2H_6$ into the $C_2H_4$ occurs via a first electrochemical cell, and wherein the method further comprises offsetting voltage and heat requirements of the first electrochemical cell.

3. The method of claim 1, wherein the $C_2H_4$ generated at the first electrochemical cell upon conversion of the $C_2H_6$ into the $C_2H_4$ is subsequently converted into a fuel or fuels using an oligomerization catalyst.

4. The method of claim 3, wherein flue gas is a source of the $CO_2$.

5. The method of claim 4, further comprising removing $N_2$ from a product of the first electrochemical cell.

6. The method of claim 5, further comprising using a complex containing cuprous ammonium salts of organic acids to form complexes with the CO in order to assist in removing the $N_2$.

7. The method of claim 2, wherein the offsetting voltage and heat requirements of the first electrochemical cell occurs via use of a second electrochemical cell.

8. The method of claim 7, further comprising converting $C_2H_6$ into $C_2H_4$ via the second electrochemical cell.

9. The method of claim 1, further comprising reducing an endothermic load associated with electrochemical $CO_2$ reduction that occurs during the conversion of the $CO_2$ to the CO.

10. The method of claim 1, wherein converting the $CO_2$ into the CO and converting the $C_2H_6$ into the $C_2H_4$ occurs simultaneously.

* * * * *